US009418676B2

(12) United States Patent
Takahashi

(10) Patent No.: US 9,418,676 B2
(45) Date of Patent: Aug. 16, 2016

(54) AUDIO SIGNAL PROCESSOR, METHOD, AND PROGRAM FOR SUPPRESSING NOISE COMPONENTS FROM INPUT AUDIO SIGNALS

(71) Applicant: Oki Electric Industry Co., Ltd., Tokyo (JP)

(72) Inventor: Katsuyuki Takahashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/432,480

(22) PCT Filed: Jun. 13, 2013

(86) PCT No.: PCT/JP2013/066401
§ 371 (c)(1),
(2) Date: Mar. 30, 2015

(87) PCT Pub. No.: WO2014/054314
PCT Pub. Date: Apr. 10, 2014

(65) Prior Publication Data

US 2015/0294674 A1 Oct. 15, 2015

(30) Foreign Application Priority Data

Oct. 3, 2012 (JP) ..... 2012-221537

(51) Int. Cl.

| | |
|---|---|
| ***G10L 21/0208*** | (2013.01) |
| ***G10L 25/78*** | (2013.01) |
| ***G10L 25/03*** | (2013.01) |
| ***H04R 1/40*** | (2006.01) |
| *G10L 21/0216* | (2013.01) |
| *H04R 3/00* | (2006.01) |

(52) U.S. Cl.
CPC ..... *G10L 21/0208* (2013.01); *G10L 25/03* (2013.01); *G10L 25/78* (2013.01); *H04R 1/40* (2013.01); *G10L 2021/02161* (2013.01); *H04R 3/005* (2013.01)

(58) Field of Classification Search
None
See application file for complete search history.

(56) References Cited

U.S. PATENT DOCUMENTS 6,453,289 B1 * 9/2002 Ertem ..... G10L 21/0208 704/225
2007/0036343 A1 2/2007 Sudo et al.
(Continued)

FOREIGN PATENT DOCUMENTS

| | | | |
|---|---|---|---|
| JP | S63-2500 | A | 1/1988 |
| JP | 2006-333215 | A | 12/2006 |
| JP | 2010-532879 | A | 10/2010 |
| JP | 2010-541010 | A | 12/2010 |
| JP | 2012-507049 | A | 3/2012 |

*Primary Examiner* — Abul Azad
(74) *Attorney, Agent, or Firm* — Rabin & Berdo, P.C.

(57) ABSTRACT

The invention provides an audio signal processing device capable of improving sound quality by causing a voice switch to operate appropriately. Delay-subtraction processing is performed on an input signal to form a first and second directional signal with nulls in a first and second specific direction, respectively, and a coherence is obtained using the two directional signals. The coherence is then compared to a determination threshold value to determine whether the input audio signal is a target-sound segment arriving from a target-direction, or a non-target-sound segment other than the target-sound segment. A gain is set according to the determination result, and any non-target-sound is attenuated by multiplying the input signal by the gain. The determination threshold value is controlled based on an average value of coherence in interfering-sound segments.

10 Claims, 15 Drawing Sheets

(56) References Cited

U.S. PATENT DOCUMENTS

| | | | | |
|---|---|---|---|---|
| 2009/0012783 | A1 | 1/2009 | Klein | |
| 2009/0089053 | A1 | 4/2009 | Wang et al. | |
| 2010/0323652 | A1 | 12/2010 | Visser et al. | |
| 2011/0038489 | A1 | 2/2011 | Visser et al. | |
| 2012/0179462 | A1 | 7/2012 | Klein | |
| 2015/0172814 | A1* | 6/2015 | Usher | H04R 3/005 381/92 |

* cited by examiner

| AVERAGE COHERENCE VALUE DIST_COH | TARGET-SOUND SEGMENT DETERMINATION THRESHOLD VALUE Θ |
|---|---|
| | |
| A TO B | Θ 1 |
| B TO C | Θ 2 |
| C TO D | Θ 3 |
| | |

SMALL

LARGE

AUDIO SIGNAL PROCESSOR, METHOD, AND PROGRAM FOR SUPPRESSING NOISE COMPONENTS FROM INPUT AUDIO SIGNALS

TECHNICAL FIELD

The present invention relates to an audio signal processor, a method, and a program applicable to, for example, communications hardware or communications software that handle audio signals such as telephone calls and teleconferences.

BACKGROUND ART

Technology known as a voice switch, technology known as a Wiener filter, and the like, are examples of noise suppression technology (see Japanese Patent Application Laid-Open (JP-A) 2006-333215 (Patent Document 1), and Japanese National-Phase Publication 2010-532879 (Patent Document 2)).

A voice switch is technology in which segments (target-sound segments) spoken by a speaker are detected in an input signal using a target-sound segment detection function, any target-sound segments are output unprocessed, and the amplitude is attenuated for any non-target-sound segments. For example, as illustrated in FIG. 12, when an input signal input is received, determination is made as to whether or not the input signal input is a target-sound segment (step S51), a gain VS_GAIN is set to 1.0 if the input signal input is a target-sound segment (step S52), and the gain VS_GAIN is set to a freely chosen positive value $\alpha$ less than 1.0 if the input signal input is a non-target-sound segment (step S53). The product of the input signal input and the gain VS_GAIN is then obtained as an output signal output (step S54).

Applying this voice switch technology to audio communications equipment such as a teleconference device or a mobile telephone enables non-target-sound segments (noise) to be suppressed and a desired target-sound to be extracted, thereby enabling an improvement in speech sound quality.

The non-target-sound can be divided into "interfering-sounds" that are human voices not belonging to the speaker, and "background noise" such as office noise or road noise. Although target-sound segments can be accurately determined using ordinary target-sound segment detection functions when the non-target-sound segments are background noise alone, erroneous determination occurs when interfering-sounds are superimposed on background noise, due to the target-sound segment detection function also designating the interfering-sound as target-sound. As a result, interfering-sounds cannot be suppressed by such voice switches, and sufficient speech sound quality is not attained.

This issue is improved by switching a feature value referenced by a target-sound segment detection section from variation in the input signal level employed hitherto, to coherence. Put simply, coherence is a feature value signifying the arrival direction of an input signal. Consider use of a mobile telephone; the speaker's voice (the target-sound) arrives from the front face, and interfering-sounds have a strong tendency to arrive from faces other than the front face, enabling target-sound to be distinguished from interfering-sounds, something that was not hitherto possible, by observing the arrival direction.

FIG. 13 is a block diagram illustrating a configuration of a voice switch when coherence is employed by a target-sound detection function.

A pair of microphones m_1, and m_2 respectively acquire input signals s1($n$) and s2($n$) through an AD converter, omitted from illustration. Note that n is an index indicating the input sequence of the samples, and is expressed as a positive integer. In the present specification, the lower the value of n, the older the input sample, and the greater the value, the newer the input sample.

An FFT section 10 acquires input signal series s1($n$) and s2($n$) from the microphones m_1 and m_2, and performs a fast Fourier transform (or a discrete Fourier transform) on the input signals s1 and s2. This thereby enables the input signals s1 and s2 to be expressed in the frequency domain. When performing fast Fourier transform, analysis frames FRAME 1 (K) and FRAME 2 (K) are formed from a specific number N of samples from the input signals s1($n$) and s2($n$), and then applied. An example of configuring the analysis frames FRAME 1 (K) from the input signal s1($n$) is represented by Equation (1) below, and similar applies to the analysis frames FRAME 1 (K).

$$\text{FRAME } 1(1) = \{s1(1), s1(2), \cdots, s1(N)\} \tag{1}$$

$$\vdots$$

$$\text{FRAME } 1(K) = \{s1(N\times(K-1)+1), s1(N\times(K-1)+2), \cdots, s1(N\times(K-1)+K)\}$$

Note that K is an index indicating a sequence number for frames, and represents a positive integer. In the present specification, the lower the value of K, the older the analysis frame, and the greater the value, the newer the analysis frame. In the explanation of operation that follows, the index that indicates the latest analysis frame, this being the analysis target, is K unless specifically stated otherwise.

The FFT section 10 performs transformation into frequency domain signals X1 (f, K), X2 (f, K) by performing a fast Fourier transform on each analysis frame, and the obtained frequency domain signals X1 (f, K) and X2 (f, K) are provided to a corresponding first directionality forming section 11, and second direction directionality forming section 12 respectively. Note that f is an index indicating the frequency. Moreover, X1 (f, K) is not a single value, and is composed from plural spectral components of frequencies f1 to fm as expressed by Equation (2). Similar applies to X2 (f, K), and to B1 (f, K) and B2 (f, K), described later.

$$X1(f,K)=[(f1,K),(f2,K),\ldots,(fm,K)] \tag{2}$$

In the first directionality forming section 11, a signal B1 (f, K) having strong directionality in a specific direction is formed from the frequency domain signals X1 (f, K) and X2 (f, K). In the second direction directionality forming section 12, a signal B2 (f, K) having strong directionality in a specific direction (different from that of the specific direction mentioned previously) is formed from the frequency domain signals X1 (f, K) and X2 (f, K). An existing method may be applied as the method of forming the signals B1 (f, K), B2 (f, K) having strong directionality in a specific direction. For example, Equation (3) may be applied to form B1 (f, K) having strong left-direction directionality, and Equation (4) may be applied to form B2 (f, K) having strong right-direction directionality. In Equation (3) and Equation (4), the frame index K has no effect on the computation and is therefore omitted.

$$B1(f) = x2(f) - X1(f) \times \exp\left[-\frac{i2\pi fS}{N}\tau\right] \quad (3)$$

$$B2(f) = x1(f) - X2(f) \times \exp\left[-\frac{i2\pi fS}{N}\tau\right] \quad (4)$$

Wherein:

S: sampling frequency

N: FFT analysis frame length

τ: Difference in sound wave arrival time between microphones i: imaginary unit f: frequency The significance of these equations is explained using FIG. 14A, FIG. 14B, FIG. 15A, and FIG. 15B, using Equation (3) as an example. Consider a sound wave arriving from a direction θ indicated in FIG. 14A picked up by a pair of microphones m_1 and m_2 positioned a distance 1 apart. In such an event, a difference arises in time until the sound wave arrives at the microphones m_1 and m_2. For a sound path difference d, this arrival time difference τ is d=1×sin θ, thus giving Equation (5), wherein c is the speed of sound.

$$\tau = 1 \times \sin\theta / c \quad (5)$$

A signal s1 (t−τ), from the input signal s1 (*n*) delayed by τ, is identical to the input signal s2 (*t*). A signal y (t) taking the difference between these signals=s2 (*t*)−s1 (*t*−τ), is accordingly a signal in which sound arriving from the direction θ is eliminated. As a result, the microphone array m_1 and m_2 have directionality as illustrated in FIG. 14B.

Although a time domain computation is described above, performing the computation in the frequency domain can be said to be equivalent. The equations in such a case are Equation (3) and Equation (4) above. Next, consider as an example changing the arrival direction θ by ±90°. Namely, the directional signal B1 (*f*) from the first directionality forming section 11 has strong directionality in the right-direction as illustrated in FIG. 15A, and the directional signal B2 (*f*) from the first directionality forming section 12 has strong directionality in the left-direction as illustrated in FIG. 15A.

The coherence COH is obtained for the directional signals B1 (*f*) and B2 (*f*), obtained as described above, by performing a calculation according to Equation (6) and Equation (7) using a coherence calculation section 13. In Equation (6), B2 (*f*)* is the complex conjugate of B2 (*f*).

$$coef(f) = \frac{|B1(f) \cdot B2(f)^*|}{\frac{1}{2}\{|B1(f)|^2 + |B2(f)|^2\}} \quad (6)$$

$$COH = \sum_{f=0}^{M-1} coef(f)/M \quad (7)$$

In a target-sound segment detection section 14, the coherence COH is compared with a target-sound segment determination threshold value Θ, determination as a target-sound segment is made if the coherence COH is greater than the threshold value Θ, otherwise determination as a non-target-sound segment is made, and the determination results VAD_RES (K) are formed.

A brief description follows regarding the reasoning behind detecting target-sound segments using the magnitude of the coherence. The concept of coherence can also be referred to as the correlation between a signal arriving from the right and a signal arriving from the left (Equation (6) above computes correlations for given frequency components, and Equation (7) calculates the average correlation value for all frequency components). It is therefore possible to say that the two directional signals B1 and B2 have little correlation with each other when the small coherence COH is small, and, conversely, have high correlation with each other when the coherence COH is large. Input signals having little correlation are sometimes cases in which the input arrival direction is offset greatly to either of the right or left, and sometimes non-offset noise-like signals that clearly have little regularity. Thus it can be said that a segment in which the coherence COH is small is an interfering-sound segment or a background noise segment (a non-target-sound segment). It can also be said that the input signal has arrived from the front face when there is large coherence COH, due to there being no offset in the arrival direction. It is assumed that target-sound will arrive from the front face, meaning that large coherence COH can be said to signify target-sound segments.

A gain controller 15 sets a gain VS_GAIN for target-sound segments to 1.0, and sets a gain VS_GAIN for non-target-sound segments (interfering-sounds, background noise) to a freely selected positive value α less than 1.0. A voice switch gain multiplication section 16 obtains a post-voice switch signal y (n) by multiplying the obtained gain VS_GAIN by an input signal s1 (*n*).

SUMMARY OF INVENTION

Technical Problem

Although the coherence COH is a large value overall when the arrival direction is approach from the front face, the coherence COH value gets smaller as the arrival direction is offset to the side. FIG. 16 illustrates changes in the coherence COH when the sound arrival direction is an approach from the front face (solid line), when the sound arrival direction is from the side (dotted line), and when the arrival direction is from an intermediate point between the front face and the side (dashed line). The vertical axis indicates the coherence COH, and the horizontal axis indicates time (the analysis frame k).

As illustrated in FIG. 16, the coherence COH has a characteristic of the value range thereof changing greatly according to the arrival direction. However, hitherto there has been an issue of erroneous determination arising since the target-sound segment determination threshold value Θ is a fixed value irrespective of the arrival direction.

For example, if the threshold value Θ is large, when the coherence COH is not a particularly large value even though it is a target-sound segment, such as segments in which the sound rises or consonant sections, the target-sound segment is erroneously determined as a non-target-sound segment. Target-sound components are accordingly attenuated by the voice switch processing, resulting in unnatural sound qualities, such as irregular interruptions.

If the threshold value Θ is set to a small value, the coherence of the interfering-sound may exceed the threshold value Θ when an interfering-sound arrives from an arrival direction approaching from the front face, and non-target-sound segments may be erroneously determined as target-sound segments. Accordingly, non-target-sound components are not attenuated and sufficient elimination performance becomes unobtainable. In addition, the rate of erroneous determinations increases when the device user is in an environment where the arrival direction of interfering-sounds changes with time.

As described above, since the target-sound segment determination threshold value 0 is a fixed value, there is the issue that the voice switching processing is sometimes not operated on desired segments, and the voice switch processing is sometimes operated on non-desired segments, thus lowering the sound quality.

An audio signal processing device, method, or program that improves sound quality by appropriately operating a voice switch is therefore desired.

Solution to Problem

A first aspect of the present invention is an audio signal processing device that suppresses noise components from input audio signals. The audio signal processing device includes (1) a first directionality forming section that by performing delay-subtraction processing on an input audio signal forms a first directional signal imparted with a directionality characteristic having a null in a first specific direction, (2) a second directionality forming section that by performing delay-subtraction processing on the input audio signal forms a second directional signal imparted with a directionality characteristic having a null in a second specific direction different from the first specific direction, (3) a coherence computation section that obtains a coherence using the first and second directional signals, (4) a target-sound segment detection section that by comparing the coherence with a first determination threshold value determines whether the input audio signal is a segment of a target-sound arriving from a target direction, or a non-target-sound segment other than the target-sound segment, (5) a target-sound segment determination threshold value controller that based on the coherence detects an interfering-sound segment from among non-target-sound segments including both the interfering-sound segment and a background noise segment, that obtains an interfering-sound average coherence value representing an average coherence value in the interfering-sound segment, and that controls the first determination threshold value based on the interfering-sound average coherence value, (6) a gain controller that sets a voice switch gain according to the determination result of the target-sound segment detection section, and (7) a voice switch gain multiplication section that multiplies the input audio signal by the voice switch gain obtained by the gain controller.

A second aspect of the present invention is an audio signal processing method that suppresses noise components from input audio signals. The audio signal processing method includes (1) by a first directionality forming section, forming a first directional signal imparted with a directionality characteristic having a null in a first specific direction by performing delay-subtraction processing on an input audio signal, (2) by a second directionality forming section, forming a second directional signal imparted with a directionality characteristic having a null in a second specific direction different from the first specific direction by performing delay-subtraction processing on the input audio signal, (3) by a coherence computation section, calculating a coherence using the first and second directional signals, (4) by a target-sound segment detection section, comparing the coherence with a first determination threshold value determines whether the input audio signal is a segment of target-sound arriving from a target direction, or a non-target-sound segment other than the target-sound segment, (5) by a target-sound segment determination threshold value controller, detecting based on the coherence an interfering-sound segment from among non-target-sound segments including both the interfering-sound segment and a background noise segment, obtaining an interfering-sound average coherence value representing an average coherence value in the interfering-sound segment, and controlling the first determination threshold value based on the interfering-sound average coherence value, (6) by a gain controller, setting a voice switch gain according to the determination result of the target-sound segment detection section; and (7) by a voice switch gain multiplication section, multiplying the input audio signal by the voice switch gain obtained by the gain controller.

An audio signal processing program of a third aspect of the present invention causes a computer to function as (1) a first directionality forming section that by performing delay-subtraction processing on an input audio signal forms a first directional signal imparted with a directionality characteristic having a null in a first specific direction, (2) a second directionality forming section that by performing delay-subtraction processing on the input audio signal forms a second directional signal imparted with a directionality characteristic having a null in a second specific direction different from the first specific direction, (3) a coherence computation section that obtains a coherence using the first and second directional signals, (4) a target-sound segment detection section that by comparing the coherence with a first determination threshold value determines whether the input audio signal is a segment of a target-sound arriving from a target direction, or a non-target-sound segment other than the target-sound segment, (5) a target-sound segment determination threshold value controller that based on the coherence detects an interfering-sound segment from among non-target-sound segments including both the interfering-sound segment and a background noise segment, that obtains an interfering-sound average coherence value representing an average coherence value in the interfering-sound segment, and that controls the first determination threshold value based on the interfering-sound average coherence value, (6) a gain controller that sets a voice switch gain according to the determination result of the target-sound segment detection section; and (7) a voice switch gain multiplication section that multiplies the input audio signal by the voice switch gain obtained by the gain controller.

Advantageous Effects of Invention

The present invention controls a determination threshold value applied to determine whether there is a target-sound segment or not, thereby causing voice switching to operate appropriately, and enabling sound quality to be improved.

DESCRIPTION OF EMBODIMENTS

A. First Exemplary Embodiment

Explanation follows regarding an audio signal processing device, method, and program of a first exemplary embodiment of the invention, with reference to the drawings. The first exemplary embodiment is able to appropriately set a determination threshold value Θ for a target-sound segment according to an arrival direction of an interfering-sound, based on the coherence COH.

A-1. Configuration of the First Exemplary Embodiment

Figure 1:
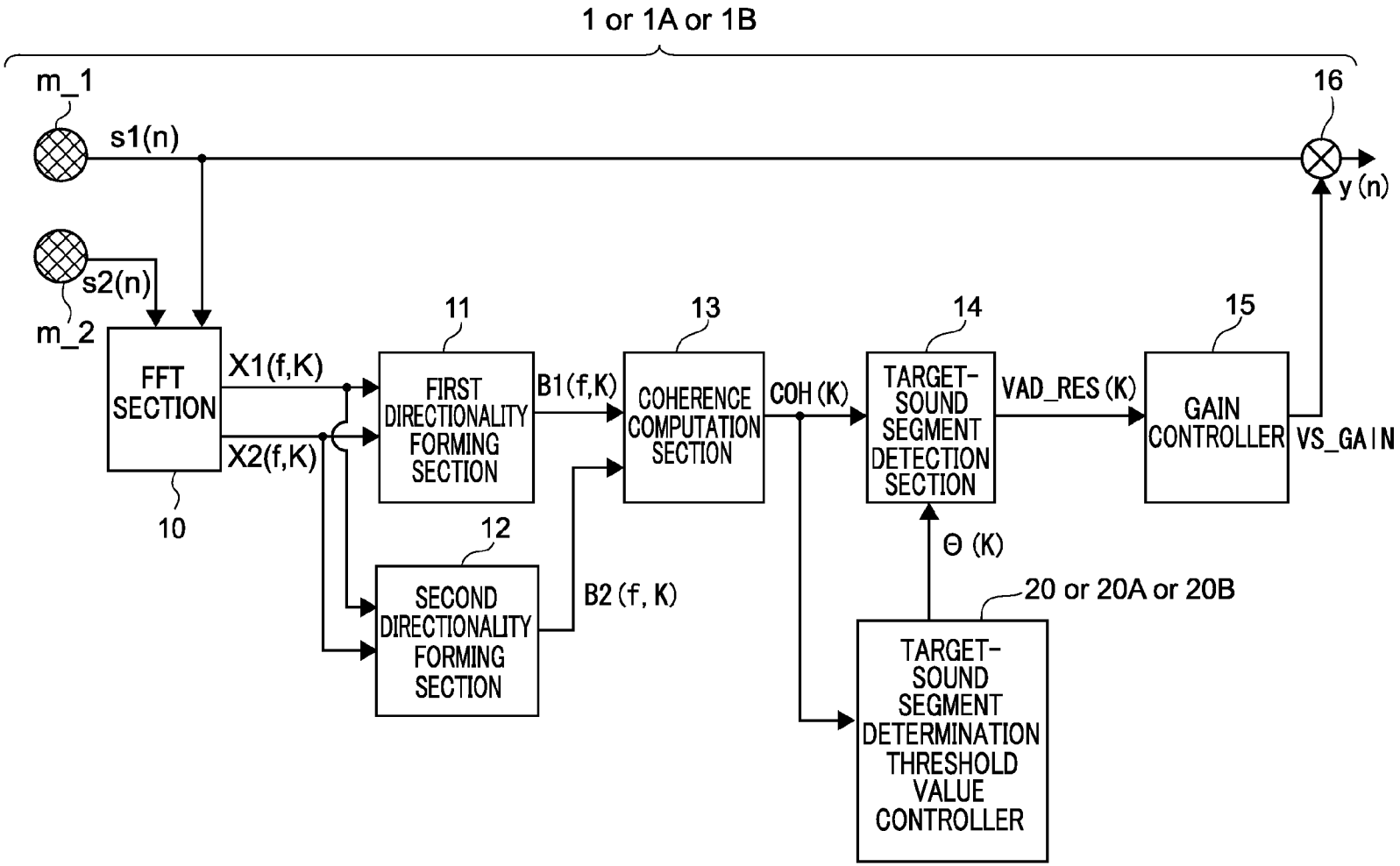
FIG. 1 is a block diagram illustrating a configuration of an audio signal processing device according to a first exemplary embodiment.
Figure 13:
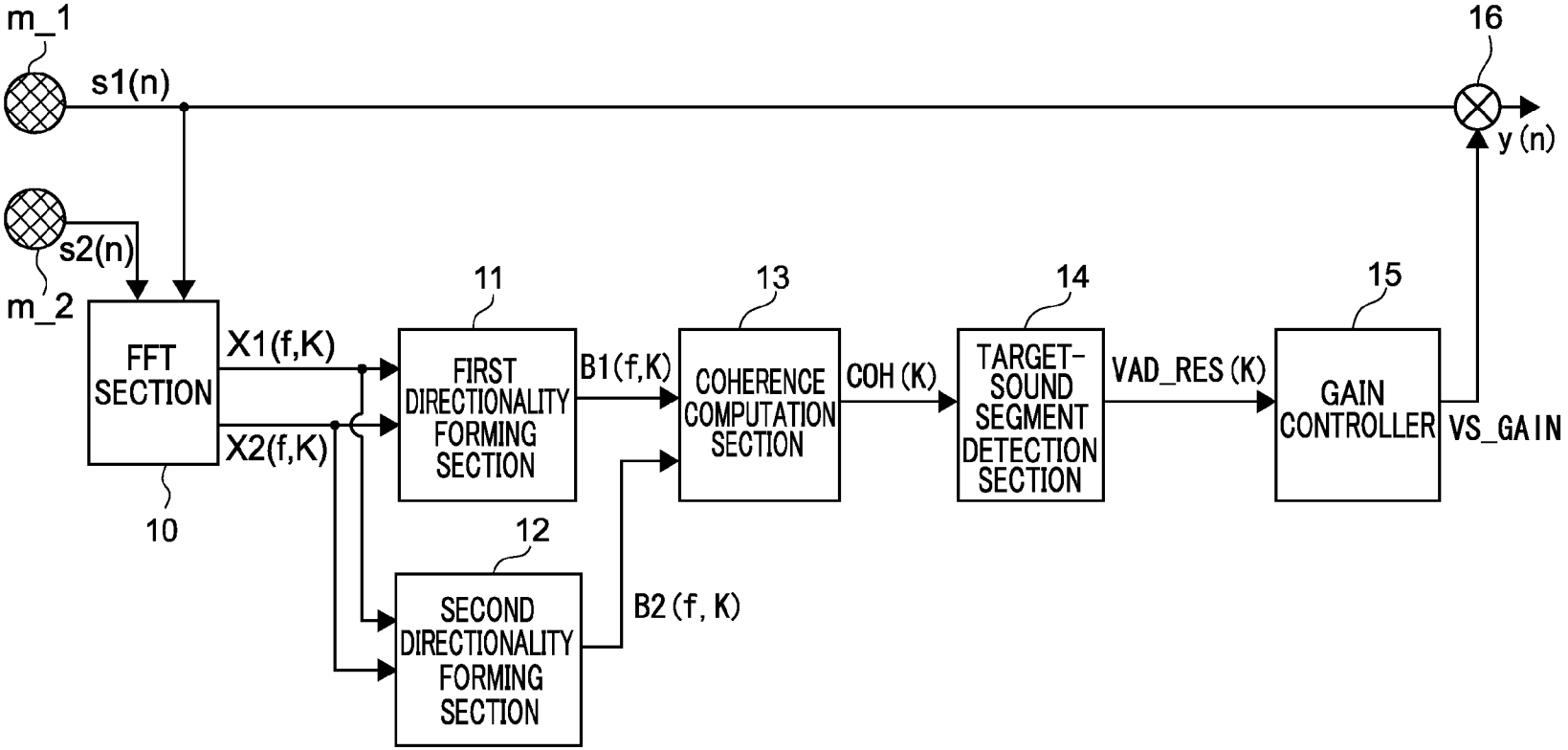
FIG. 13 is a block diagram illustrating a configuration of a voice switch when coherence is employed in a target-sound detection function.
Figure 14A:
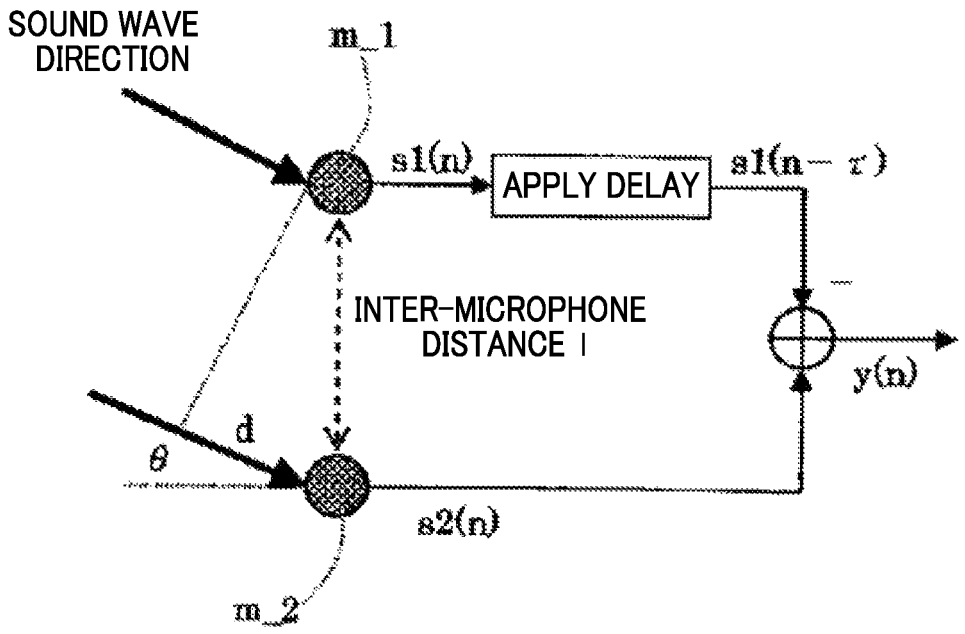
FIG. 14A is an explanatory diagram illustrating properties of a directional signal from the directionality forming section of FIG. 13.
Figure 14B:
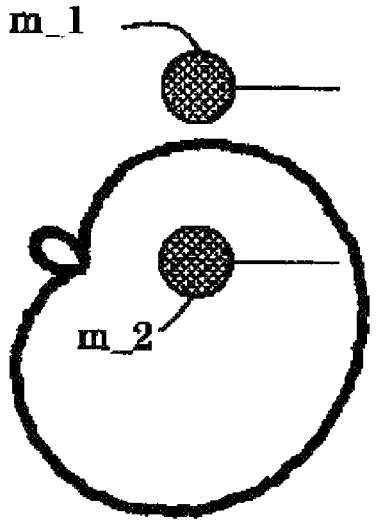
FIG. 14B is an explanatory diagram illustrating properties of a directional signal from the directionality forming section of FIG. 13.
Figure 15A:
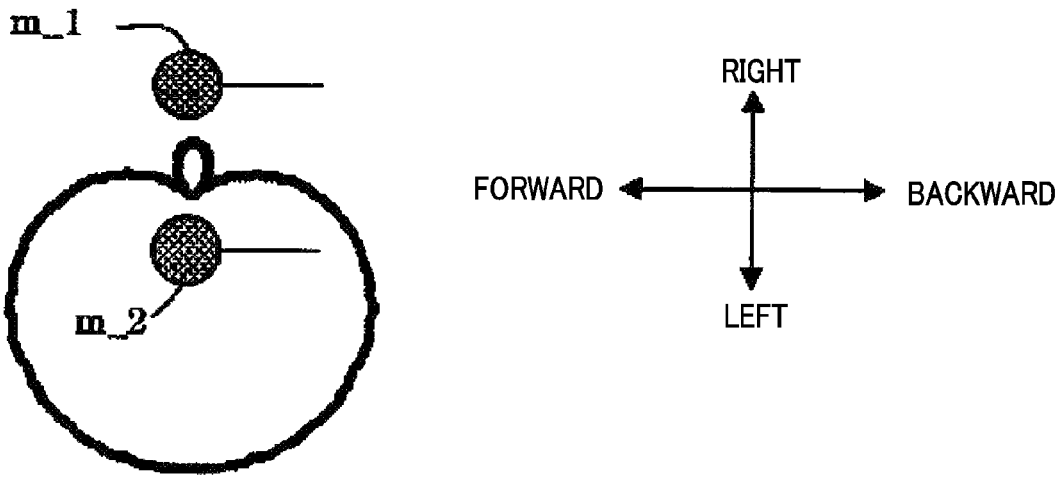
FIG. 15A is an explanatory diagram illustrating properties of directionality in the directionality forming section of FIG. 13.
Figure 15B:
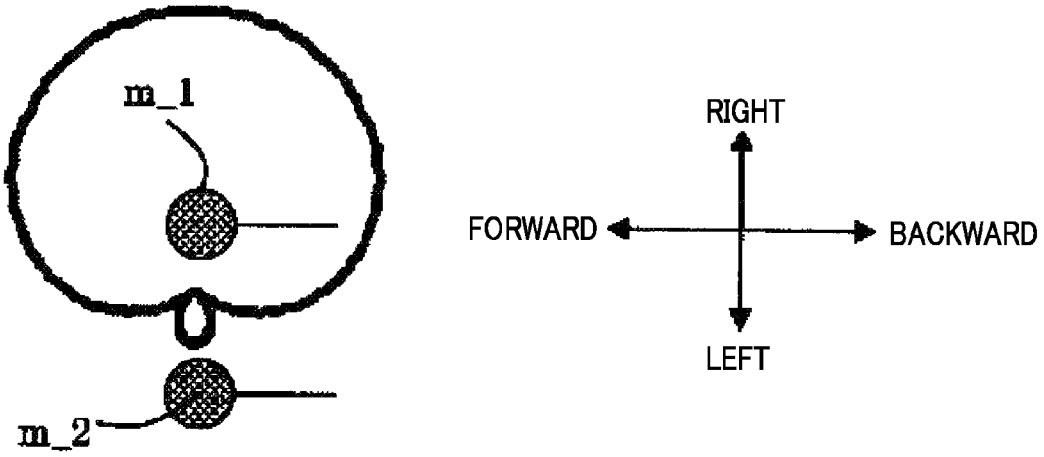
FIG. 15B is an explanatory diagram illustrating properties of directionality in the directionality forming section of FIG. 13.

FIG. 1 is a block diagram illustrating a configuration of an audio signal processing device according to the first exemplary embodiment. Corresponding sections similar to those in FIG. 13 are illustrated appended with the same reference numeral. Except for the pair of microphones m_1 and m_2, the audio signal processing device may be implemented by software executed by a CPU (an audio signal processing program); in terms of function however, the audio signal processing device can be represented by FIG. 1.

In FIG. 1, an audio signal processing device 1 according to a first exemplary embodiment includes a target-sound segment determination threshold value controller 20, in addition to microphones m_1, m_2, an FFT section 10, a first directionality forming section 11, a second directionality forming section 12, a coherence computation section 13, a target-sound segment detection section 14, a gain controller 15, and a voice switch gain multiplication section 16 similar to technology hitherto.

Since the microphones m_1, m_2, the FFT section 10, the first directionality forming section 11, the second direction directionality forming section 12, the coherence computation section 13, the gain controller 15, and the voice switch gain multiplication section 16 carry out functions similar to those of technology hitherto, explanation of such functionality is omitted.

Based on a calculated coherence COH (K), the coherence computation section 13 of the target-sound segment determination threshold value controller 20 sets a target-sound segment determination threshold value Θ (K) according to the arrival direction at that time, in the target-sound segment detection section 14.

The target-sound segment detection section 14 of the first exemplary embodiment compares the coherence COH (K) with the target-sound segment determination threshold value Θ (K) set by variable control, makes determination as a target-sound segment if the coherence COH (K) is greater than the threshold value Θ (K), and otherwise makes determination as a non-target-sound segment, and forms determination results VAD_RES (K).

Figures 2, 3:
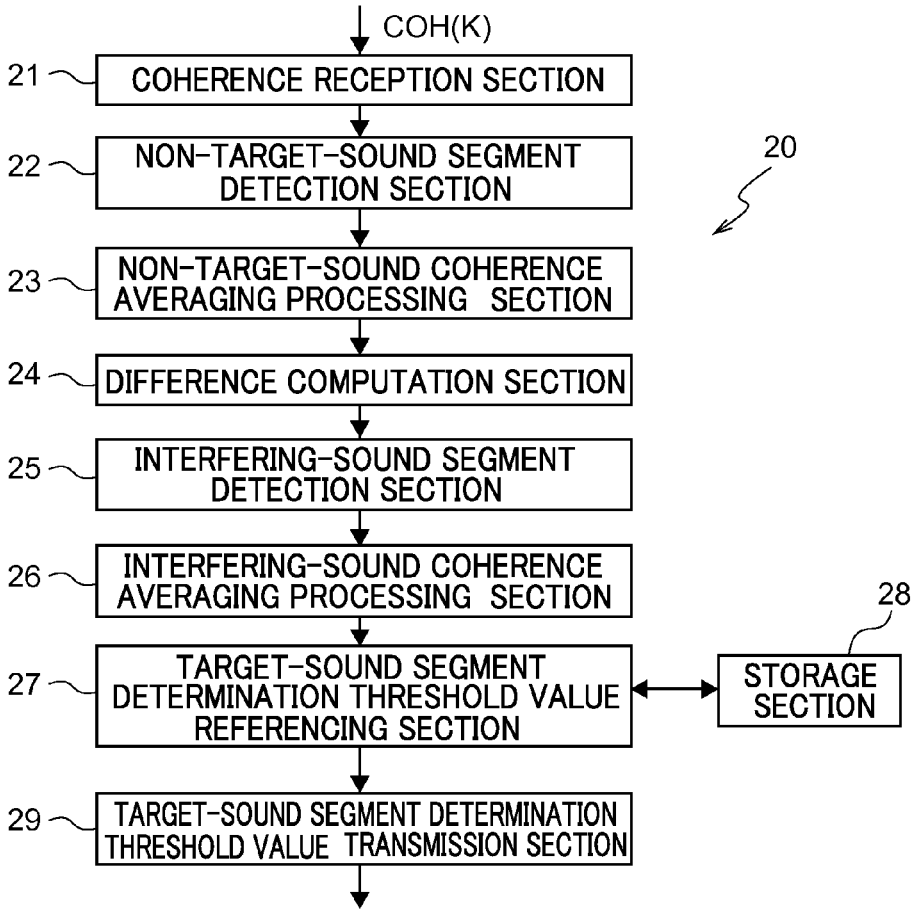
FIG. 2 is a block diagram illustrating a detailed configuration of a target-sound segment determination threshold value controller of an audio signal processing device of the first exemplary embodiment.
FIG. 3 is an explanatory diagram of storage content of a target-sound segment determination threshold value controller of an audio signal processing device of the first exemplary embodiment.

FIG. 2 is a block diagram illustrating detailed configuration of the target-sound segment determination threshold value controller 20.

The target-sound segment determination threshold value controller 20 includes a coherence reception section 21, a non-target-sound segment detection section 22, a non-target-sound coherence averaging processing section 23, a difference computation section 24, an interfering-sound segment detection section 25, an interfering-sound coherence averaging processing section 26, a target-sound segment determination threshold value referencing section 27, a storage section 28, and a target-sound segment determination threshold value transmission section 29.

The coherence reception section 21 acquires the coherence COH (K) computed by the coherence computation section 13.

The non-target-sound segment detection section 22 makes an approximate determination of whether or not a segment of coherence COH (K) is a non-target-sound segment. This approximate determination is a comparison of the coherence COH (K) against a fixed threshold value Ψ. Determination as a non-target-sound segment is made when the coherence COH (K) is smaller than the fixed threshold value Ψ. The determination threshold value Ψ is a value different from the target-sound segment determination threshold value Θ controlled with time using the target-sound segment detection section 14, and a fixed value is applied as the determination threshold value Ψ since it is sufficient to detect non-target-sound segments to a rough approximation with no need for high precision, unlike the determination threshold value Θ.

In the non-target-sound coherence averaging processing section 23, if the approximate determination result is a target-sound segment, the value AVE_COH (K−1) of the immediately previous analysis frame K−1 may be applied, as is, as an average value of coherence AVE_COH (K) for the non-target-sound segment. If the approximate determination result is a non-target-sound segment, the average value AVE_COH (K) of the coherence in the non-target-sound segment may be derived by Equation (8). Note that the computation method for the average coherence value AVE_COH (K) is not limited to Equation (8), and another computation method, such as simple averaging of a specific number of sample values, may be applied. In Equation (8), δ is a value within a range of $0.0<\delta<1.0$.

$$AVE_COH(K)=\delta\times COH(K)+(1-\delta)\times AVE_COH(K-1) \quad (8)$$

A weighted sum of the coherence COH (K) for the input audio of the current frame segment (the $K^{th}$ analysis frame, counting from the point in time when operation started) and the average value AVE_COH (K−1) obtained for the one previous frame segment may be calculated as the average value using Equation (8), and the contribution to the average value made by instantaneous coherence values COH (K) may be adjusted via the magnitude of the value δ. Setting δ to a small value close to 0 enables variation caused by instantaneous values to be suppressed since the contribution of instantaneous values to the average is lessened. Setting δ to a value close to 1 enables the effect of averaging processing to be weakened since the contribution of instantaneous values is increased. An appropriate value of δ may be set based on these viewpoints.

The difference computation section 24 calculates the absolute value DIFF (K) of the difference between the instantaneous value COH (K) and the average value AVE_COH (K) of the coherence, as expressed by Equation (9).

$$DIFF(K)=|COH(K)-AVE_COH(K)| \quad (9)$$

The interfering-sound segment detection section 25 compares the value DIFF (K) with an interfering-sound segment determination threshold value Φ, and makes determination as an interfering-sound segment if the value DIFF (K) is the interfering-sound segment determination threshold value Φ or greater, and otherwise makes determination as a segment other than an interfering-sound segment (a background noise segment). The determination method utilizes a property of the difference from the average becoming large due to the value of the coherence (the instantaneous coherence) in interfering-sound segments being greater than in background noise segments.

If the determination result is not an interfering-sound segment, the interfering-sound coherence averaging processing section 26 applies the value DIST_COH (K−1) of the immediately previous analysis frame K−1, as is, as the average value DIST_COH (K) of the coherence in interfering-sound segments, and if the determination result is an interfering-sound segment, the interfering-sound coherence averaging processing section 26 derives the average value DIST_COH (K) of the coherence in the interfering-sound segment according to Equation (10), which is similar to Equation (8). The calculation equation for the coherence average value DIST_COH (K) is not limited to Equation (10), and another computation method, such as simple averaging of a specific number of sample values, may be applied therefor. In Equation (10), ζ is a value within a range of $0.0<\zeta<1.0$.

$$DIST_COH(K)=\zeta\times COH(K)+(1-\zeta)\times DIST_COH(K-1) \quad (10)$$

The storage section 28 stores correspondence data of the range of the average value DIST_COH of the coherence in interfering-sound segments against the target-sound segment determination threshold value Θ. The storage section 28 may, for example, be configured in a conversion table format as illustrated in FIG. 3. The example of FIG. 3 shows a value of Θ 1 as the target-sound segment determination threshold value Θ corresponded against the average value DIST_COH of the coherence in interfering-sound segments when in a range A<DIST_COH≤B, a value of Θ 2 as the target-sound segment determination threshold value Θ corresponded against the average value DIST_COH of the coherence in interfering-sound segments when in a range B<DIST_COH≤C, and a value of Θ 3 as the target-sound segment determination threshold value Θ corresponded against the average value DIST_COH of the coherence in interfering-sound segments when in a range C<DIST_COH≤D. The relationship Θ 1<Θ 2<Θ 3 holds here.

The target-sound segment determination threshold value referencing section 27 searches the storage section 28 for the average value DIST_COH range to which the average value DIST_COH (K) obtained by the interfering-sound coherence averaging processing section 26 belongs, and acquires the value of the target-sound segment determination threshold value Θ corresponding to the found range of the average value DIST_COH.

As the target-sound segment determination threshold value Θ (K) applied for the current analysis frame K, the target-sound segment determination threshold value transmission section 29 transmits the value of the target-sound segment determination threshold value Θ acquired by the target-sound segment determination threshold value referencing section 27 to the target-sound segment detection section 14.

A-2. Operation of the First Exemplary Embodiment

Explanation next follows regarding operation of the audio signal processing device 1 of the first exemplary embodiment with reference to the drawings, explaining in sequence about the overall operation, and detailed operations in the target-sound segment determination threshold value controller 20.

The input signals s1(*n*), s2(*n*) from the pair of microphones m_1 and m_2 are respectively transformed by the FFT section 10 from time domain into frequency domain signals X1 (f, K), X2 (f, K), and then directional signals B1 (f, K), B2 (f, K) are generated with specific directions as nulls thereof by the first and second directionality forming sections 11 and 12, respectively. Then, the directional signals B1 (f, K) and B2 (f, K) are applied in the coherence computation section 13, calculations of Equation (6) Equation (7) are executed, and the coherence COH (K) is computed.

In the target-sound segment determination threshold value controller 20, a target-sound segment determination threshold value Θ (K) according to the arrival direction of a non-target-sound (in particular, an interfering-sound) at that time, is derived based on the coherence COH (K) and provided to the target-sound segment detection section 14. Then, in the target-sound segment detection section 14, determination as a target-sound segment or not is performed by comparing the coherence COH (K) with the target-sound segment determination threshold value Θ (K), and the gain VS_GAIN is set by the gain controller 15 that received the determination result VAD_RES (K). Then, in the voice switch gain multiplication section 16, the input signal s1 (*n*) is multiplied by the gain VS_GAIN set by the gain controller 15, and the output signal y (n) is obtained.

Figure 4:
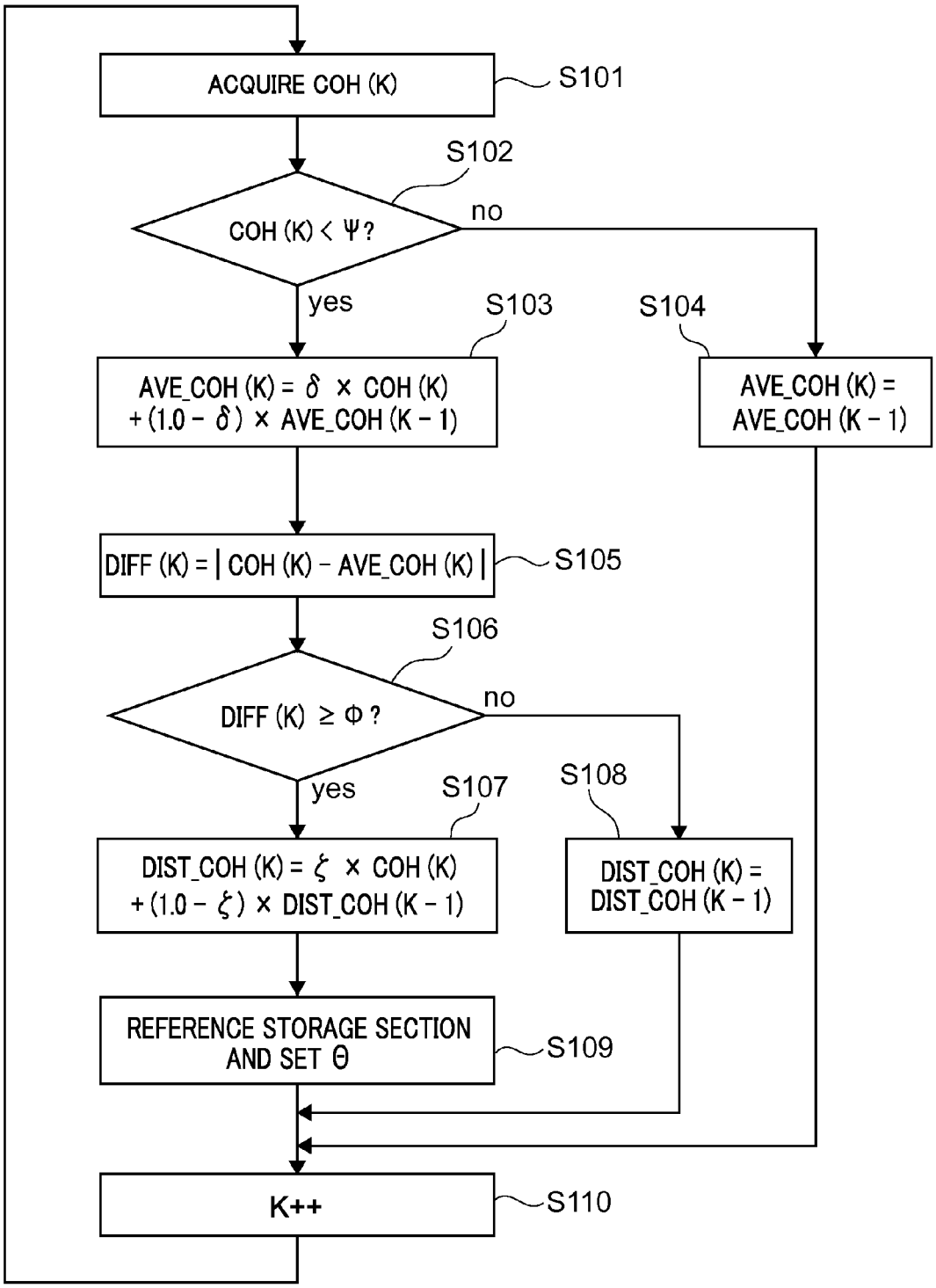
FIG. 4 is a flowchart illustrating operation of a target-sound segment determination threshold value controller of an audio signal processing device according to the first exemplary embodiment.

Explanation next follows regarding operation of the target-sound segment determination threshold value controller 20. FIG. 4 is a flowchart illustrating the operation of the target-sound segment determination threshold value controller 20.

The coherence COH (K) calculated by the coherence computation section 13 and input to the target-sound segment determination threshold value controller 20 is acquired by the coherence reception section 21 (step S101). The acquired coherence COH (K) is compared with the fixed threshold value Ψ in the non-target-sound coherence averaging processing section 23, and determination as a non-target-sound segment or not is performed (step S102). If the determination result is a target-sound segment (if coherence COH (K)≥Ψ), the average value AVE_COH (k−1) of the immediately previous analysis frame K−1 is applied by the non-target-sound coherence averaging processing section 23, as is, as the average value AVE_COH (K) of the coherence in the non-target-sound segment (step S103). If the determination result is a non-target-sound segment (if coherence COH (K)<Ψ), the average value AVE_COH (K) of the coherence in the non-target-sound segment is computed according to Equation (8) (step S104).

Next, the absolute value DIFF (K) of the difference between the instantaneous coherence value COH (K) and the average value AVE_COH (K) is computed by the difference computation section 24 according to Equation (9) (step S105). Then, in the interfering-sound segment detection section 25, the value DIFF (K) obtained by the calculation is compared with the interfering-sound segment determination threshold value D, and determination as an interfering-sound segment is made if the value DIFF (K) is the interfering-sound segment determination threshold value 1 or greater, otherwise determination is made as a segment other than an interfering-sound segment (a background noise segment) (step S106). In the interfering-sound coherence averaging processing section 26, the value DIST_COH (K−1) in the immediately previous analysis frame K−1 is applied, as is, as the average value DIST_COH (K) of the coherence in the interfering-sound segment if the determination result is not an interfering-sound segment (step S108), and the average value DIST_COH (K) of the coherence in the interfering-sound segment is computed according to Equation (10) if the determination result is an interfering-sound segment (step S107).

Search processing is performed on the storage section 28 by the target-sound segment determination threshold value referencing section 27 using the average value DIST_COH (K) of the interfering-sound segments obtained as described above as a key. The value of the target-sound segment determination threshold value Θ corresponding to the average value range to which the key that is the average value DIST_COH (K) belongs is acquired and transmitted by the target-sound segment determination threshold value transmission section 29 to the target-sound segment detection section 14 as the target-sound segment determination threshold value Θ (K) applied to the current analysis frame K (step S109). The parameter K is then incremented by 1 (step S110), and processing returns to processing by the coherence reception section 21.

Explanation next follows regarding obtaining an optimized target-sound segment determination threshold value Θ (K) by the above processing.

Figure 16:
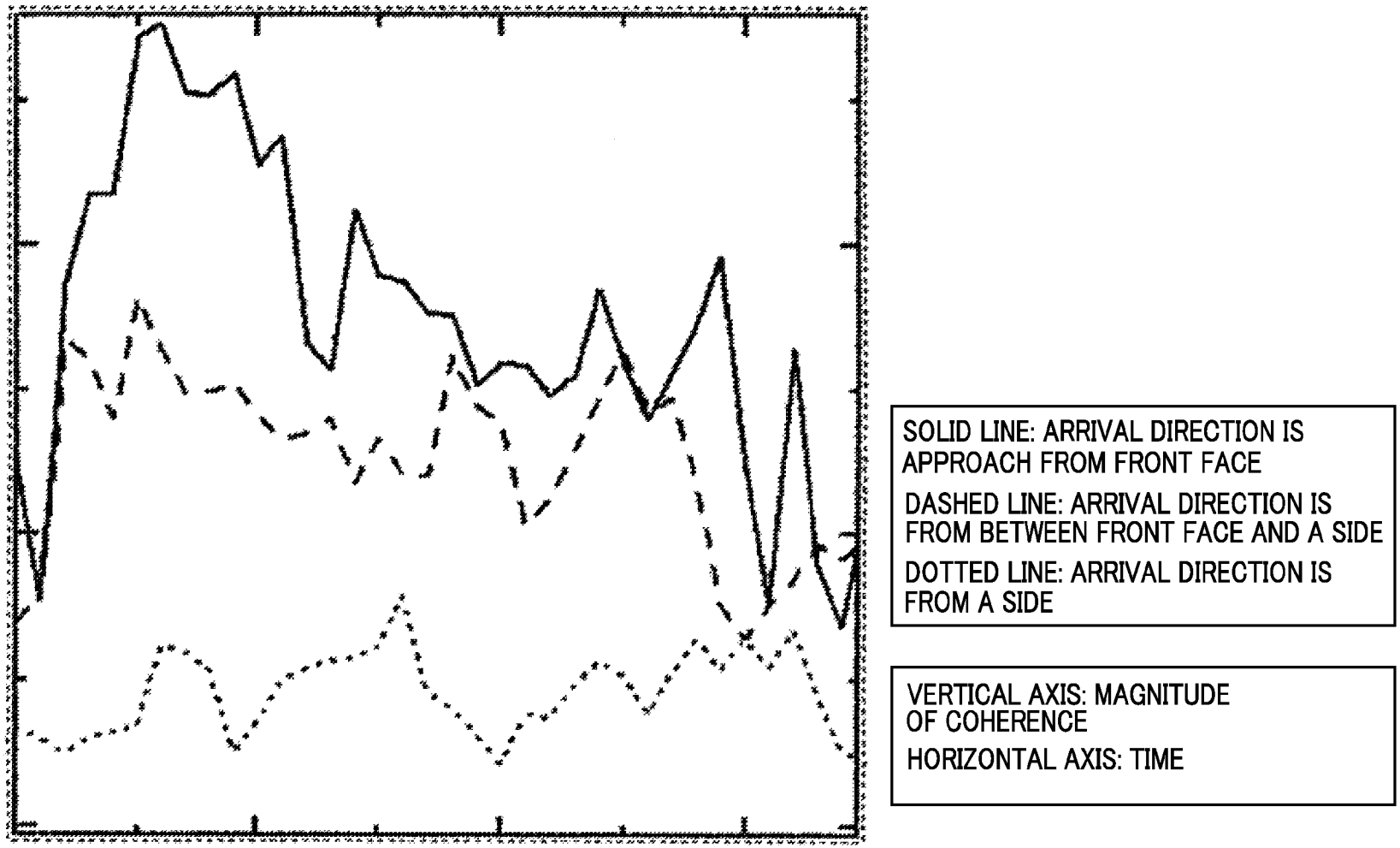
FIG. 16 is an explanatory diagram illustrating coherence variation differing according to arrival direction of sound.

As illustrated in FIG. 16, the coherence COH has a value range that differs according to the arrival direction, enabling the average value of the coherence to be corresponded against the arrival direction. This means that the arrival direction can be estimated by obtaining the average value of the coherence. Since the voice switch processing allows target-sound to pass through unprocessed, and performs processing to attenuate interfering-sounds, detection of the arrival direction of interfering-sounds is desired. Interfering-sound segments are therefore detected by the interfering-sound segment detection section 25, and average value DIST_COH (K) of the coherence in non-target-sound segments is computed by the interfering-sound coherence averaging processing section 26.

A-3. Advantageous Effects of the First Exemplary Embodiment

According to the first exemplary embodiment, the target-sound segment determination threshold value Θ is controlled according to the arrival direction of a non-target-sound (in particular, an interfering-sound), enabling determination precision to be increased for target-sound segments and non-target-sound segments, and can help to prevent sound quality from deteriorating by mistaken operation of voice switch processing other than on segments where desired.

An improvement in speech sound quality can therefore be anticipated when applying the audio signal processing device, method, or program of the first exemplary embodiment to a communications device, such as a teleconference device or mobile telephone.

B. Second Exemplary Embodiment

Explanation next follows regarding an audio signal processing device, a method, and a program of a second exemplary embodiment according to the present invention, with reference to the drawings.

In rare cases, the interfering-sound segment detection method of the first exemplary embodiment sometimes makes an interfering-sound segment detection despite the segment not being an interfering-sound segment, and the second exemplary embodiment is configured to help prevent such erroneous detection. In the first exemplary embodiment, the detection method for the interfering-sound segment, for example a background noise segment immediately following transition from a target-sound segment to a non-target-sound segment, sometimes makes an interfering-sound segment detection despite the segment not being an interfering-sound segment. Errors also arise in the setting of the target-sound segment determination threshold value Θ (K) if the average value DIST_COH of the coherence is updated by such erroneous detections.

An audio signal processing device 1A according to the second exemplary embodiment, and an overall configuration thereof, may be illustrated by FIG. 1 used to explain the first exemplary embodiment. A target-sound segment determination threshold value controller 20A according to the second exemplary embodiment, and an internal configuration thereof, may be illustrated by FIG. 2 used to explain the first exemplary embodiment.

In the case of the second exemplary embodiment, the condition for the interfering-sound segment detection section 25 to make determination as an interfering-sound segment is different from that of the first exemplary embodiment.

The determination condition in the first exemplary embodiment was "the value DIFF (K) is the interfering-sound segment determination threshold value Φ or greater"; however, the determination condition in the second exemplary embodiment is "the value DIFF (K) is the interfering-sound segment determination threshold value Φ or greater, and the coherence COH (K) is greater than the average coherence value AVE_COH (K) in a non-target-sound segment".

Explanation follows regarding the reasoning behind this modification to the determination condition. Although, in background noise segments, the coherence has a small value and small variation, the value is large in interfering-sound segments, albeit not as large as for target-sound segments, and the variation is large. Accordingly, there is often a big difference between the instantaneous coherence value COH (K) in an interfering-sound segment and the average value AVE_COH (K). This characteristic is taken into account by the condition of the value DIFF (K) being the interfering-sound segment determination threshold value Θ or greater. However, with just this condition, erroneous determinations arise as described above. The cause is that, although the average value AVE_COH (K) of the coherence of non-target-sound segments is a large value in background noise segments immediately following target-sound segments due to residual effects of the coherence in the immediately previous interfering-sound segment, the difference between the instantaneous value and the average value increases due to the instantaneous coherence value COH (K) being a small value in the background noise segments, and the value DIFF (K) that is the absolute value thereof is therefore also made large. Thus, in the second exemplary embodiment, erroneous determination is prevented by adding the condition "COH (K)>AVE_COH (K)" of the instantaneous coherence value of an interfering-sound segment being greater than the average value.

Figure 5:
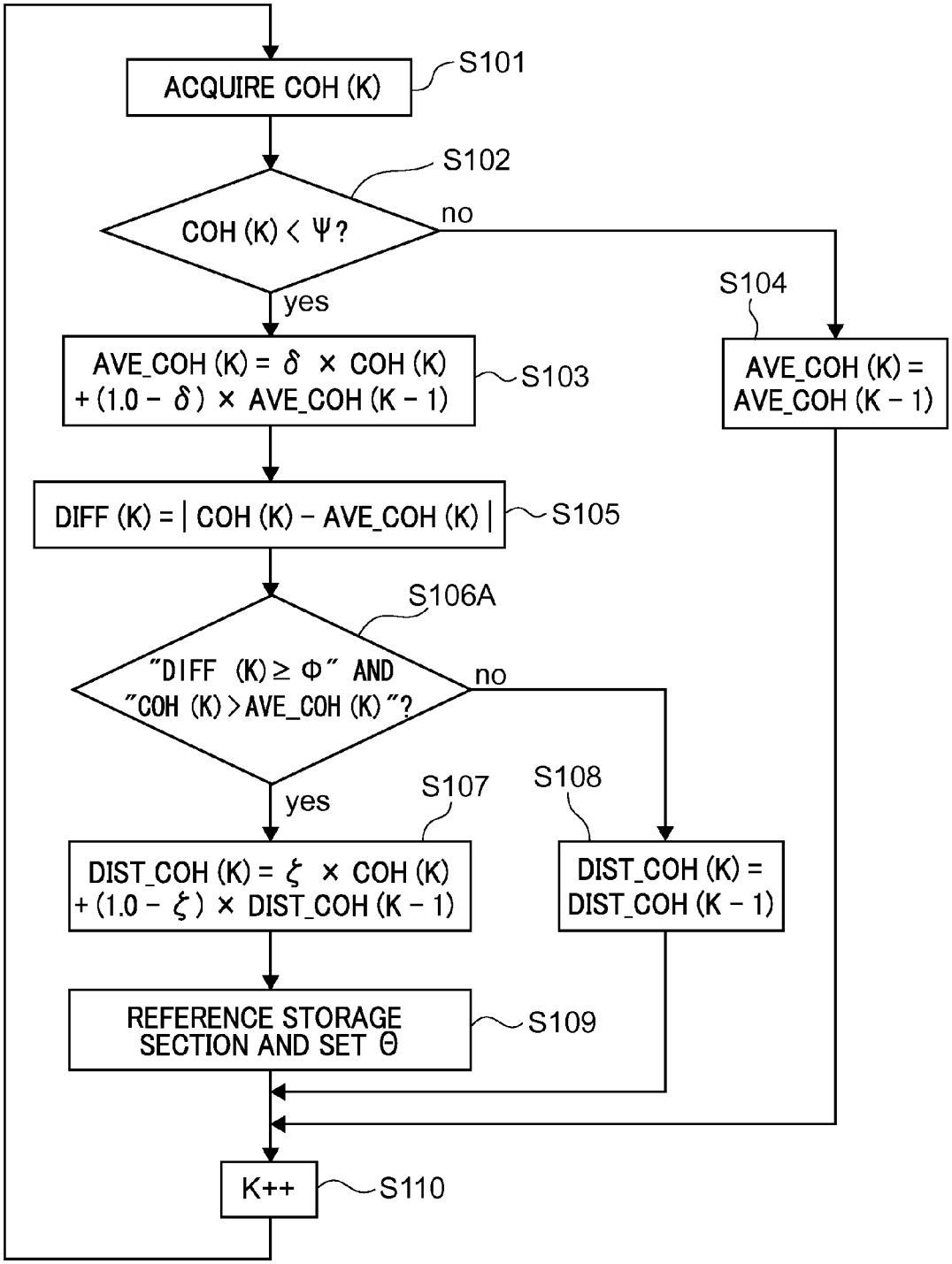
FIG. 5 is a flowchart illustrating operation of a target-sound segment determination threshold value controller of an audio signal processing device according to a second exemplary embodiment.

FIG. 5 is a flowchart illustrating operation of the target-sound segment determination threshold value controller 20A of the second exemplary embodiment, and corresponding steps to those in FIG. 4 of the first exemplary embodiment are appended with the same reference numerals.

As described above, in the second exemplary embodiment, a step S106A that is the determination step for interfering-sound segments is modified from "DIFF (K)≥Φ" of step S106 of the first exemplary embodiment to "value DIFF (K)≥Φ, and COH (K)>AVE_COH (K)", and other processing is similar to that of the first exemplary embodiment.

As described above, according to the second exemplary embodiment, erroneous updates to the average coherence value of the interfering-sound segments can be prevented even in the case of, for example, a background noise segment immediately following the end of a target-sound segment, enabling the level of determination precision of target-sound segments to be further improved since the target-sound segment determination threshold value can be set to an appropriate value.

An improvement in speech sound quality can therefore be anticipated when the audio signal processing device, method, or program of the second exemplary embodiment is applied to a communications device, such as a teleconference device or mobile telephone.

C. Third Exemplary Embodiment

Explanation next follows regarding an audio signal processing device, a method, and a program of a third exemplary embodiment according to the present invention, with reference to the drawings.

The coherence COH in non-target-sound segments suddenly increases immediately after switching from a background noise segment to an interfering-sound segment. However, since the average coherence value DIST_COH (K) of the interfering-sound segment is an average value, variation does not immediately appear in the average coherence value DIST_COH (K) even when the coherence COH suddenly increases. Namely, the coherence average value DIST_COH (K) tracks sudden increases in the coherence COH poorly. As a result, the average coherence value DIST_COH (K) of the interfering-sound segments is not accurate immediately after switching from a background noise segment to an interfering-sound segment. The third exemplary embodiment takes such points into consideration, and is configured to give an appropriate average coherence value DIST_COH (K) of the interfering-sound segments, employed in setting the target-sound segment determination threshold value, even immediately after switching from a background noise segment to an interfering-sound segment. Specifically, the third exemplary embodiment is configured to control the time constant ζ in Equation (10) immediately after switching from a background noise segment to an interfering-sound segment.

C-1. Configuration of the Third Exemplary Embodiment

An audio signal processing device 1B according to the third exemplary embodiment, and an overall configuration thereof, may be illustrated by FIG. 1 employed to explain the first exemplary embodiment.

Figure 6:
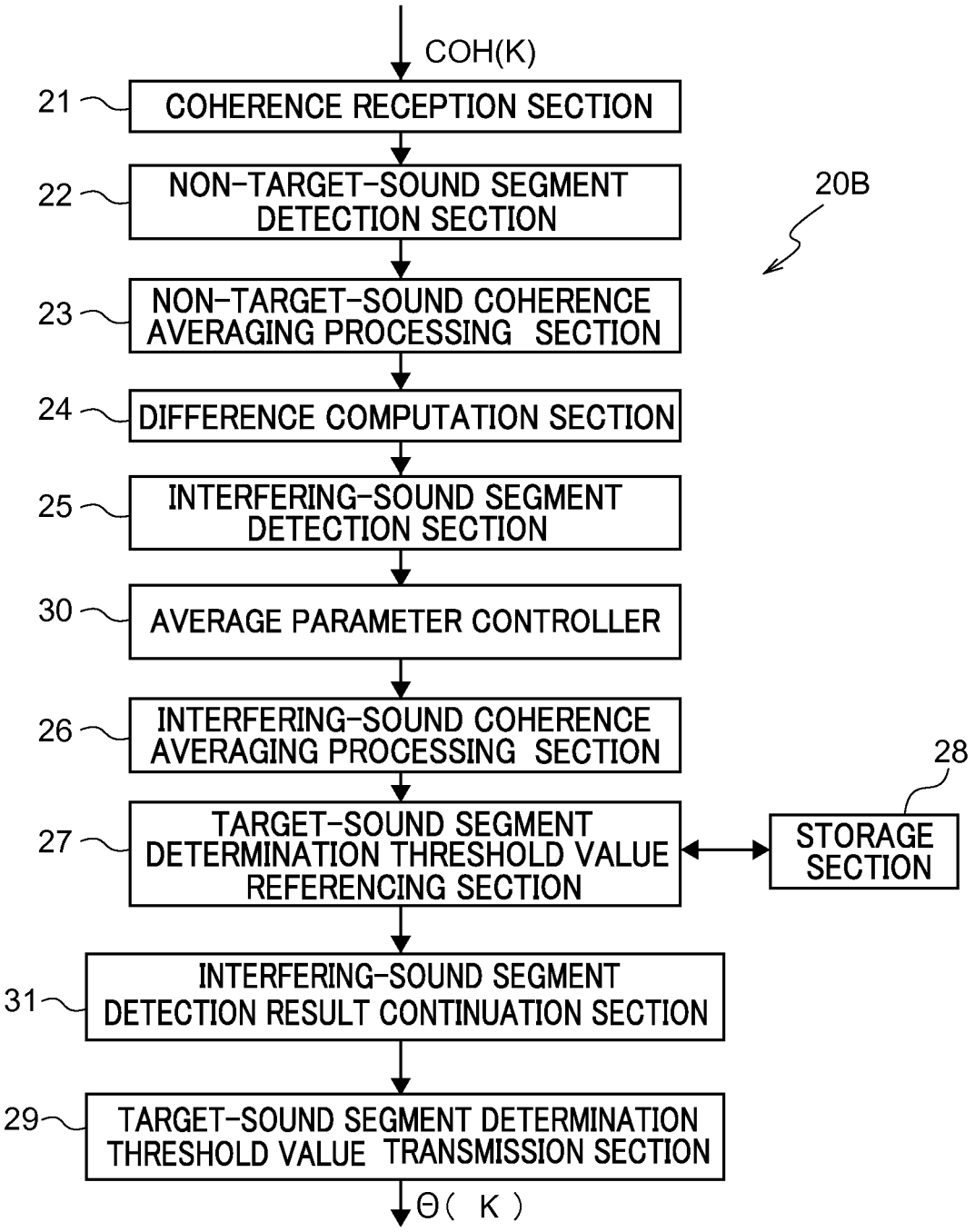
FIG. 6 is a block diagram illustrating a detailed configuration of a target-sound segment determination threshold value controller of an audio signal processing device according to a third exemplary embodiment.

FIG. 6 is a block diagram illustrating a detailed configuration of a target-sound segment determination threshold value control section 20B of the third exemplary embodiment, and parts corresponding to similar parts in FIG. 2 of the second exemplary embodiment are appended with the same reference numerals.

The target-sound segment determination threshold value control section 20B of the third exemplary embodiment includes an average parameter controller 30 and an interfering-sound segment determination result continuation section 31, in addition to the coherence reception section 21, the non-target-sound segment detection section 22, the non-target-sound coherence averaging processing section 23, the difference computation section 24, the interfering-sound segment detection section 25, the interfering-sound coherence averaging processing section 26, the target-sound segment determination threshold value referencing section 27, the storage section 28, and the target-sound segment determination threshold value transmission section 29 of the second exemplary embodiment. The average parameter controller 30 is interposed between the interfering-sound segment detection section 25 and the interfering-sound coherence averaging processing section 26, and the interfering-sound segment determination result continuation section 31 is interposed between the target-sound segment determination threshold value referencing section 27 and the target-sound segment determination threshold value transmission section 29.

The average parameter controller 30 receives the determination result of the interfering-sound segment detection section 25, and stores 0 in determination result storing variable var_new if the determination result is not an interfering-sound segment, and stores 1 in the determination result storing variable var_new if the determination result is an interfering-sound segment. This is then compared with the determination result storing variable var_old of the immediately previous frame. If the determination result storing variable var_new of the current frame exceeds the determination result storing variable var_old of the immediately previous frame, the average parameter controller 30 treats this as a transition from a background noise segment to an interfering-sound segment, and sets a large fixed value near to 1.0 (larger than an initial value, described later) as the average parameter ζ employed in the computation of the average coherence value for the interfering-sound segment. If the determination result storing variable var_new of the current frame does not exceed the determination result storing variable var_old of the immediately previous frame, the average parameter controller 30 sets the initial value as the average parameter ζ employed in the calculation of the average coherence value of the interfering-sound segment.

The interfering-sound coherence averaging processing section 26 of the third exemplary embodiment applies the average parameter ζ set by the average parameter controller 30, and performs the computation of Equation (10) above.

The interfering-sound segment determination result continuation section 31 overwrites the determination result storing variable var_old of the immediately previous frame with the determination result storing variable var_new of the current frame when the setting processing of the average parameter ζ for the current frame has ended, and then continues the processing on the next frame.

C-2. Operation of the Third Exemplary Embodiment

Explanation next follows regarding detailed operation of the target-sound segment determination threshold value control section 20B of the audio signal processing device 1B of the third exemplary embodiment, with reference to the drawings. The overall operation of the audio signal processing device 1B of the third exemplary embodiment is similar to the overall operation of the audio signal processing device 1 of the first exemplary embodiment, and explanation thereof is omitted.

Figure 7:
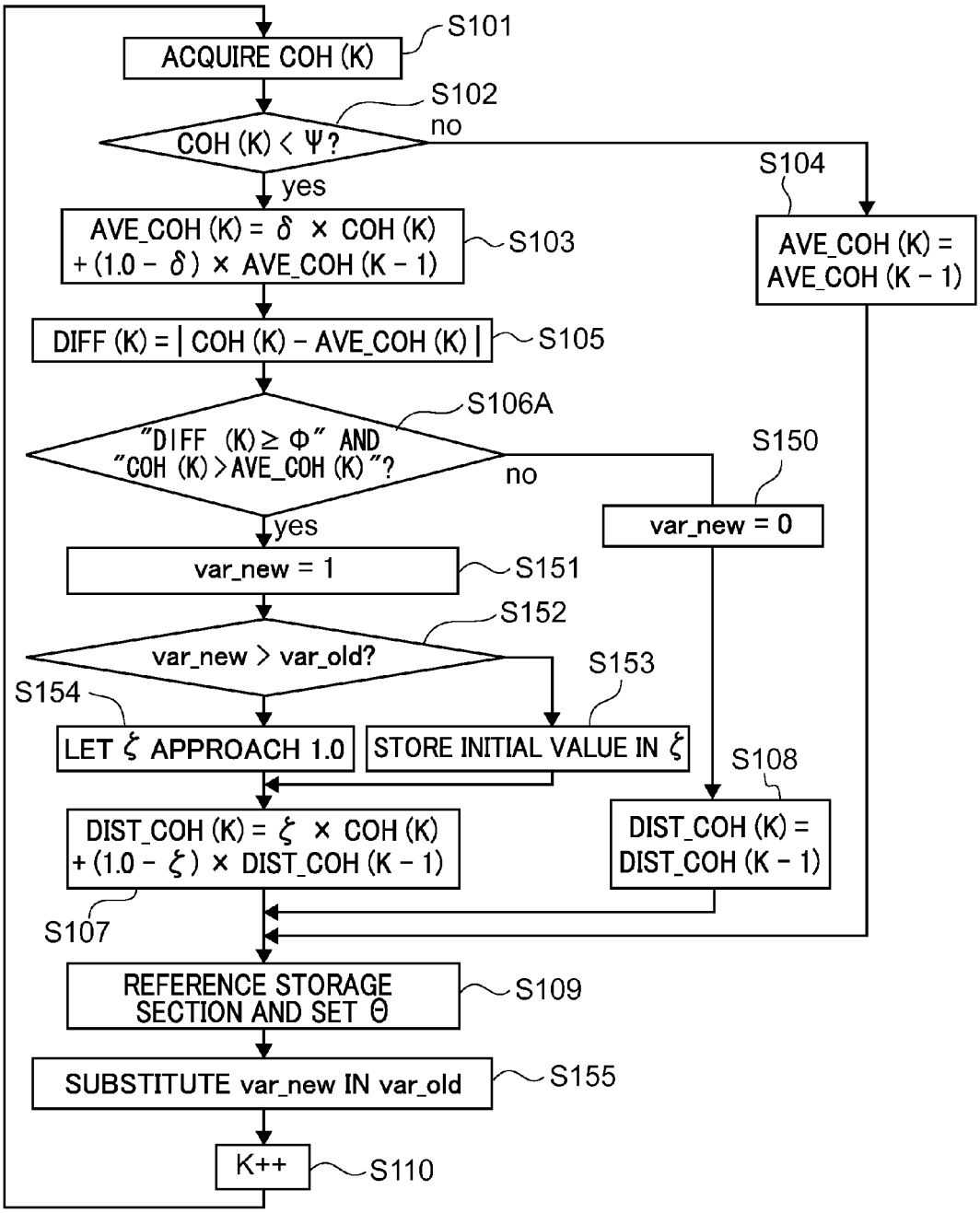
FIG. 7 is a flowchart illustrating operation of a target-sound segment determination threshold value controller of an audio signal processing device according to the third exemplary embodiment.

FIG. 7 is a flowchart illustrating operation of the target-sound segment determination threshold value control section 20B of the third exemplary embodiment, and corresponding steps to those in FIG. 5 of the second exemplary embodiment are appended with the same reference numerals.

The coherence COH (K) that was calculated by the coherence computation section 13 and input to the target-sound segment determination threshold value control section 20B, is acquired by the coherence reception section 21 (step S101), and is compared with the fixed threshold value Ψ in the non-target-sound coherence averaging processing section 23, and determination is performed as to whether it is a non-target-sound segment (step S102). If the determination result is a target-sound segment (if COH (K)≥Ψ), the average value AVE_COH (K−1) of the immediately previous analysis frame K−1 is applied by the non-target-sound coherence averaging processing section 23, as is, as the average value AVE_COH (K) of coherence in the non-target-sound segment (step S103). If the determination result is a non-target-sound segment (if COH (K)<Ψ), the average value AVE_COH (K) of coherence is computed for the non-target-sound segment according to Equation (8) (step S104).

Next, the absolute value DIFF (K) of the difference between the instantaneous coherence value COH (K) and the average value AVE_COH (K) is computed by the difference computation section 24 according to Equation (9) (step S105). Then, in the interfering-sound segment detection section 25, determination is made as to whether or not the interfering-sound segment condition "the value DIFF (K) being the interfering-sound segment determination threshold value Φ or greater, and the coherence COH (K) being greater than the average value AVE_COH (K) of the coherence of the non-target-sound segment", is satisfied (step S106A).

In the average parameter controller 30, 0 is stored in the determination result storing variable var_new of the current frame when this condition is not satisfied (when not an interfering-sound segment) (step S150). Then, in the interfering-sound coherence averaging processing section 26, the value DIST_COH (K−1) of the immediately previous analysis frame K−1 is applied, as is, as the average value DIST_COH (K) of the coherence of the interfering-sound segments (step S108).

In the average parameter controller 30, 1 is stored in the determination result storing variable var_new of the current frame when the interfering-sound segment condition is satisfied (when being an interfering-sound segment) (step S151), and then the determination result storing variable var_new of the current frame is compared with the determination result storing variable var_old of the immediately previous frame (step S152). When the determination result storing variable var_new of the current frame exceeds the determination result storing variable var_old of the immediately previous frame, a large fixed value close to 1.0 is set by the average parameter controller 30 as the average parameter ζ employed in the computation of the average coherence value of the interfering-sound segments (step S154). When the determination result storing variable var_new of the current frame does not exceed the determination result storing variable var_old of the immediately previous frame, the initial value is set by the average parameter controller 30 as the average parameter ζ employed in the computation of the average coherence value of the interfering-sound segments (step S153). After this setting is made, the average coherence value DIST_COH (K) of the interfering-sound segments is computed by the interfering-sound coherence averaging processing section 26 according to Equation (10) (step S107).

Search processing in the storage section 28 is executed by the target-sound segment determination threshold value referencing section 27 using the average value DIST_COH (K) of interfering-sound segments obtained as described above as a key. The value of the target-sound segment determination threshold value Θ corresponding to the average value range to which the key that is the average value DIST_COH (K) belongs is acquired and transmitted by the target-sound segment determination threshold value transmission section 29 to the target-sound segment detection section 14 as the target-sound segment determination threshold value Θ (K) applied to the current analysis frame K (step S109).

The interfering-sound segment determination result continuation section 31 then overwrites the determination result storing variable var_old of the immediately previous frame with the determination result storing variable var_new of the current frame (step S155). The parameter K is then incremented by 1 (step S110), and processing returns to processing by the coherence reception section 21.

The value stored in the determination result storing variable var_new of the current frame and the determination result storing variable var_old of the immediately previous frame are not limited to 1 and 0. When different values are stored, the determination condition of step S152 may be modified according to those values Although explanation has been given of cases in which the average parameter ζ is set to a large value close to 1.0 for just 1 frame immediately after a switch from a background noise segment to an interfering-sound segment, the average parameter ζ may be set to a large value close to 1.0 continuously for an exact specific number of frames by counting a number of frames from a frame immediately after the switch. For example, control may be performed such that the average parameter ζ is set to a large value close to 1.0 continuously for 5 frames immediately after the switch, and is restored to the initial value for frames thereafter.

C-3. Advantageous Effects of the Third Exemplary Embodiment

According to the third exemplary embodiment, a switch from a background noise segment to an interfering-sound segment is detected, and a parameter in the computation method of the average coherence of the interfering-sound segment is controlled when the switch is made. This thereby enables delay in tracking of the average coherence to be suppressed to a minimum limit, such that the target-sound segment determination threshold value can be set more appropriately.

An improvement in speech sound quality can therefore be anticipated when the audio signal processing device, method, or program of the third exemplary embodiment is applied to a communications device, such as a teleconference device or mobile telephone.

D. Other Exemplary Embodiments

Although various modified exemplary embodiments have been mentioned in the explanations of each of the exemplary embodiments above, more examples of modified exemplary embodiments can be given, such as the examples below.

Although the average coherence value DIST_COH (K) in the interfering-sound segments is updated in Equation (10) based on the coherence COH (K) of the current frame, depending on the characteristics of noise, sometimes a detection method that somewhat relaxes the effect of instantaneous coherence COH (K) caused by random noise characteristics is more accurate. In such cases, the average coherence value DIST_COH (K) of the interfering-sound segments may be updated based on the average coherence value AVE_COH (K) of the non-target-sound segments. Equation (11) below is a calculation equation for such a modified exemplary embodiment.

$$\mathrm{DIST_COH}(K)=\zeta\times\mathrm{AVE_COH}(K)+(1-\zeta)\times\mathrm{DIST_COH}(K-1) \tag{11}$$

Although examples have been given for each of the above exemplary embodiments in which the target-sound segment detection section establishes the threshold value to be employed based on the average coherence value of the interfering-sound segments, the parameters employed in deciding the threshold value are not limited to the average coherence value. It is sufficient that the parameters are able to reflect trends in the coherence of the immediately previous time period to some extent. For example, the threshold value may be set based on a peak coherence obtained by applying a known peak holding technique. Moreover, the threshold value may be set based on a statistical quantity such as a coherence distribution or standard deviation.

Although an examples have been given for each of the above exemplary embodiments, in which the non-target-sound coherence averaging processing section 23 uses a single fixed threshold value Ψ to choose which of two update methods to apply for the average coherence value, three or more methods may be prepared as the update methods for the average coherence value, and a number of threshold values matching the number of update methods may be set. For example, plural update methods may be prepared with mutually different δ values for Equation (8).

One out of a known spectral subtraction, coherence filter, or Weiner filter may be employed in combination with each of the above exemplary embodiments, or two or all thereof may be employed in combination. Combined employment enables greater noise suppression performance to be realized. A simple description follows of the configuration and operation when spectral subtraction, a coherence filter, or a Weiner filter is employed in combination with the first exemplary embodiment.

Figure 8:
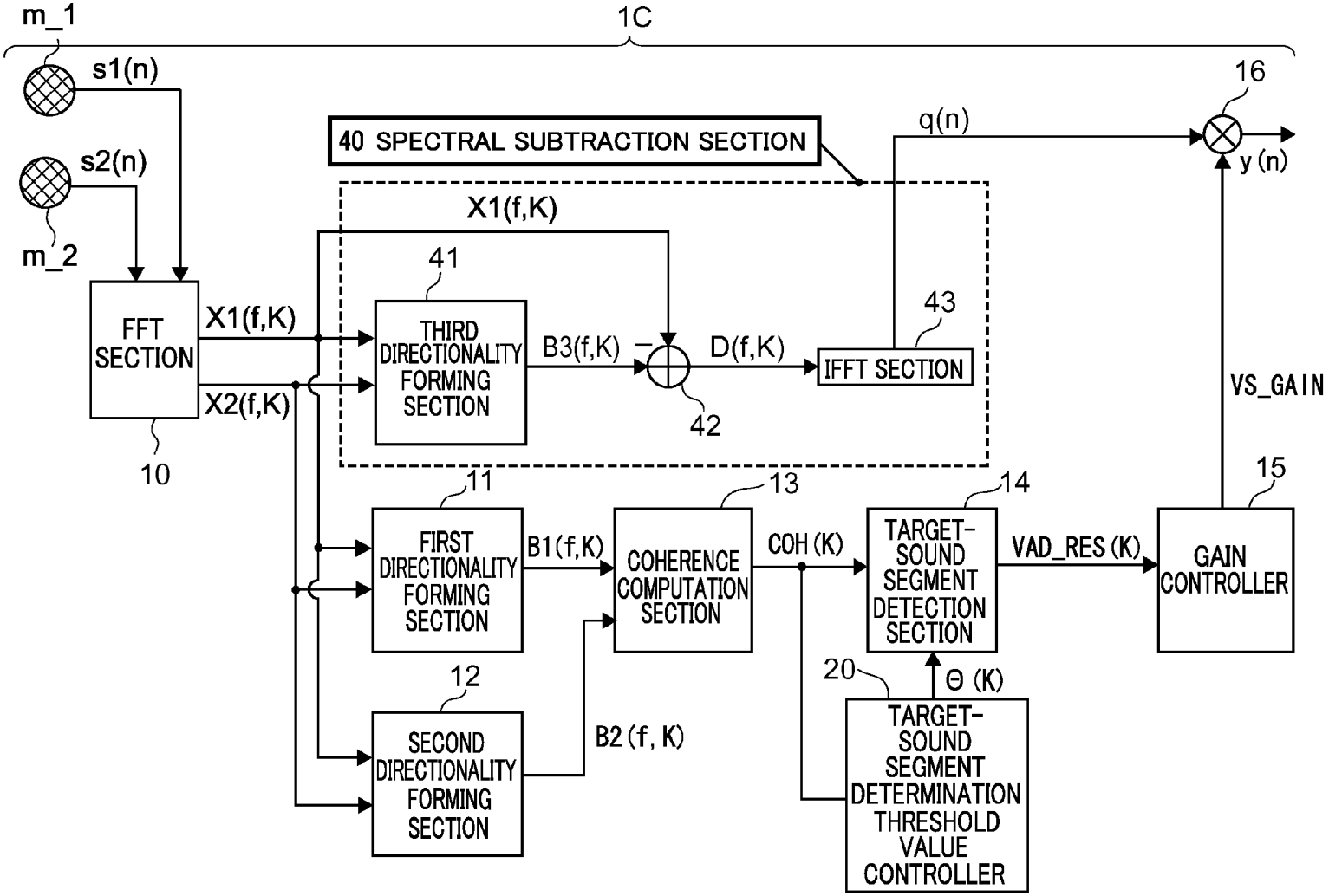
FIG. 8 is a block diagram illustrating a configuration of a modified exemplary embodiment in which frequency attenuation subtraction is employed in combination with the first exemplary embodiment.

FIG. 8 is a block diagram illustrating a configuration of a modified exemplary embodiment in which spectral subtraction is employed in combination with the first exemplary embodiment, with corresponding steps to those in FIG. 1 of the first exemplary embodiment appended with the same reference numerals.

In FIG. 8, in addition to the configuration of the first exemplary embodiment, an audio signal processing device 1C according to this modified exemplary embodiment includes a spectral subtraction section 40. The spectral subtraction section 40 includes a third directionality forming section 41, a subtraction section 42, and an IFFT section 43.

"Spectral subtraction" here refers to a means of performing noise suppression by subtracting non-target-sound signal components from the input signal.

Figure 9:
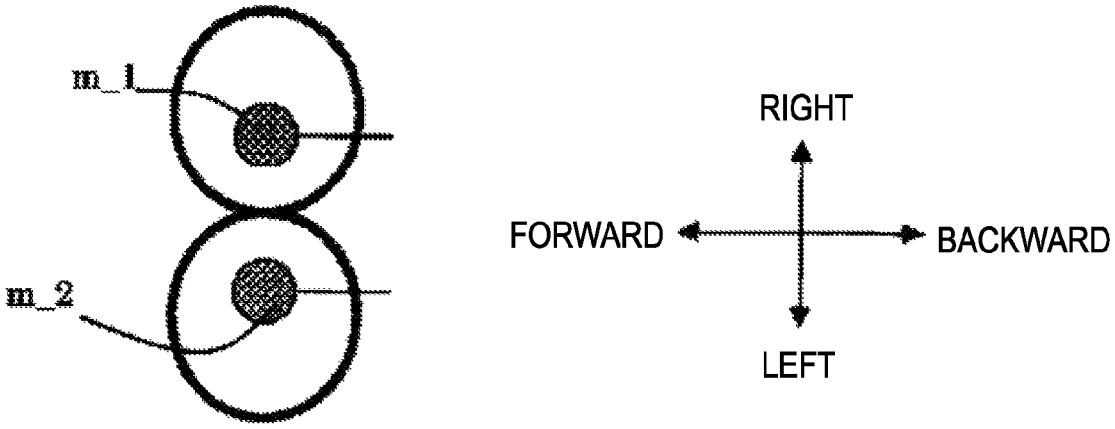
FIG. 9 is an explanatory diagram illustrating properties of a directional signal from the third directionality forming section of FIG. 8.

The third directionality forming section 41 is provided with the two input signals X1 (f, K) and X2 (f, K) from the FFT section 10 that have been transformed to the frequency domain. By executing Equation (12), the third directionality forming section 41 forms a third directional signal B3 (f, K) conforming to a directionality characteristic having a null at a front face, as illustrated in FIG. 9, and the third directional signal B3 (f, K) acting as a noise signal is provided to the subtraction section 42 as input for subtraction. One of the signals transformed to the frequency domain, the input signal X1 (f, K), is provided to the subtraction section 42 as input for subtraction from, and, as expressed by Equation (13), the subtraction section 42 obtains a frequency subtracted processed signal D (f, K) by subtracting the third directional signal B3 (f, K) from the input signal X1 (f, K). The IFFT section 43 transforms the frequency subtracted processed signal D (f, K) to a time domain signal q (n), and provides the time domain signal q (n) to the voice switch gain multiplication section 16.

$$B3(f,K)=X1(f,K)-X2(f,K) \tag{12}$$

$$D(f,K)=X1(f,K)-B3(f,K) \tag{13}$$

Figure 10:
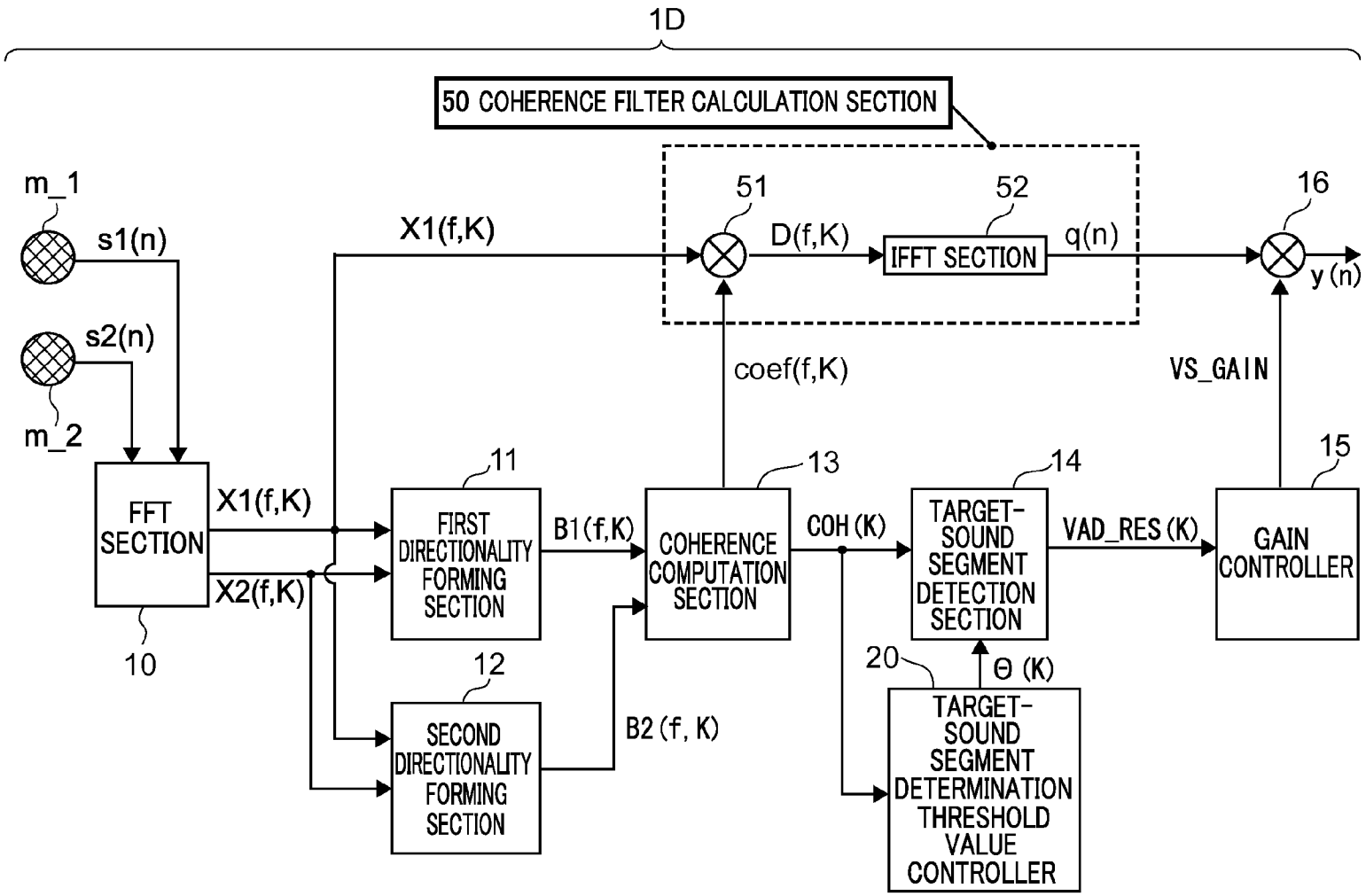
FIG. 10 is a block diagram illustrating a configuration of a modified exemplary embodiment in which a coherence filter is employed in combination with the first exemplary embodiment.

FIG. 10 is a block diagram illustrating a configuration of a modified exemplary embodiment, of a coherence filter employed in combination with the first exemplary embodiment, and corresponding steps to those in FIG. 1 of the first exemplary embodiment are appended with the same reference numeral.

In FIG. 10, an audio signal processing device 1D according to this modified exemplary embodiment includes a coherence filter calculation section 50 in addition to the configuration of the first exemplary embodiment. The coherence filter calculation section 50 includes a coherence filter coefficient multiplication section 51 and an IFFT section 52.

A "coherence filter" is a noise elimination technique, in which signal components having an offset arrival direction are suppressed by multiplying each frequency of the input signal by a coef (f, K) obtained using Equation (6) above.

As expressed by Equation (14), the coherence filter coefficient multiplication section 51 multiplies the input signal X (f, K) by a coefficient coef (f, K) obtained by a computation process of the coherence computation section 13, obtaining a post-noise-suppression signal D (f, K). The IFFT section 52 transforms the post-noise-suppression signal D (f, K) into a time domain signal q (n), and provides the time domain signal q (n) to the voice switch gain multiplication section 16.

$$D(f,K)=X1(f,K)\times\mathrm{coef}(f,K) \tag{14}$$

Figure 11:
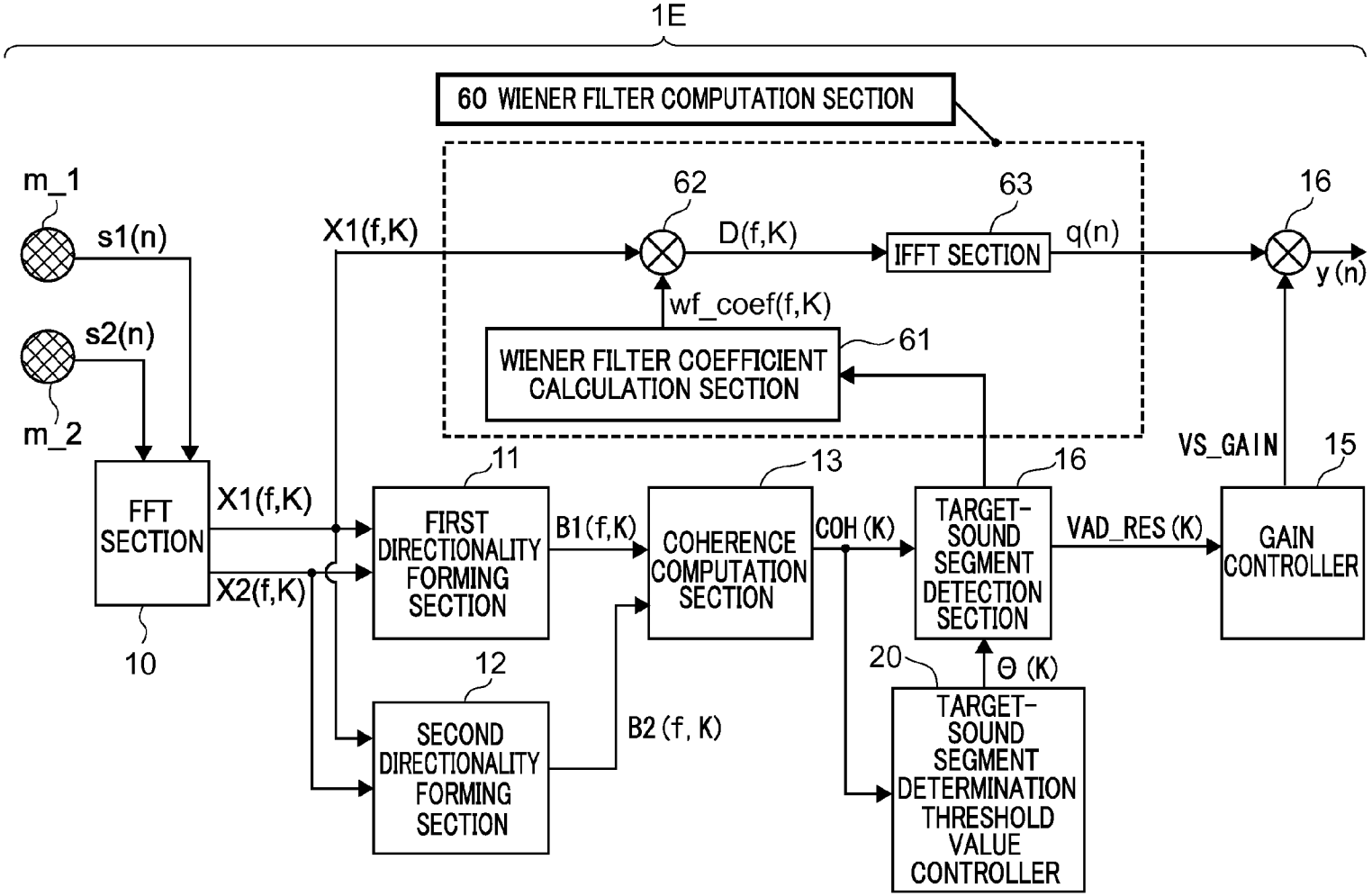
FIG. 11 is a block diagram illustrating a configuration of a modified exemplary embodiment in which a Wiener filter is employed in combination with the first exemplary embodiment.
Figure 12:
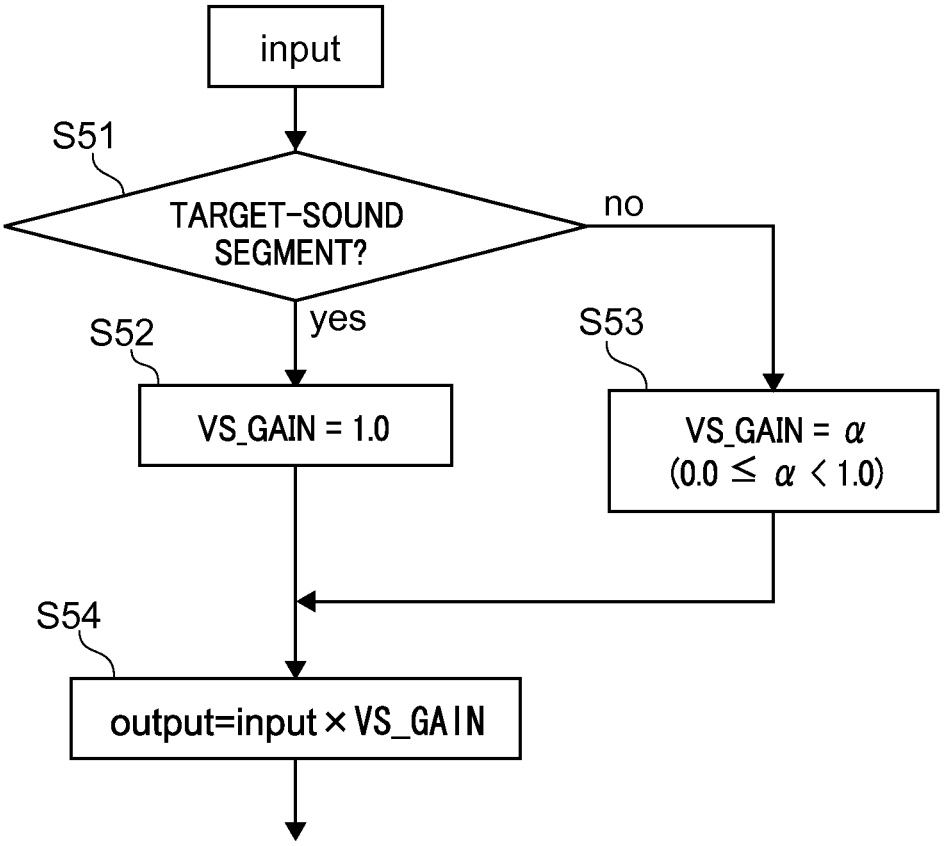
FIG. 12 is a flowchart illustrating a flow of voice switch processing.

FIG. 11 is a block diagram illustrating a configuration of a modified exemplary embodiment, in which a Wiener filter is employed in combination with the first exemplary embodiment, and corresponding portions to those in FIG. 1 of the first exemplary embodiment are appended with the same reference numerals.

In FIG. 11, in addition to the configuration of the first exemplary embodiment, an audio signal processing device 1E according to this modified exemplary embodiment includes a Wiener filter computation section 60. The Wiener filter computation section 60 includes a Wiener filter coefficient calculation section 61, a Wiener filter coefficient multiplication section 62, and an IFFT section 63.

As described in Patent Document 2, a "Wiener filter" here is technology that estimates noise characteristics per frequency from a signal of a noise segment, and eliminates the noise by multiplying by obtained coefficients.

The Wiener filter coefficient calculation section 61 references the detection result of the target-sound segment detection section 14, and estimates a Wiener filter coefficient wf_coef (f, K) if the detection result is a non-target-sound segment (see the computation equation "Equation (3)" of Patent Document 2). However, a Wiener filter coefficient is not estimated if the detection result is a target-sound segment. The Wiener filter coefficient multiplication section 62 obtains a post-noise-suppression signal D (f, K) by multiplying the input signal X1 (f, K) by the Wiener filter coefficient wf_coef (f, K), as expressed by Equation (15). The IFFT section 63 transforms the post-noise-suppression signal D (f, K) into a time domain signal q (n), and provides the time domain signal q (n) to the voice switch gain multiplication section 16.

$$D(f,K)=X1(f,K)\times wf_coef(f,K) \quad (15)$$

In the spectral subtraction processing above, an example is given in which voice switching processing is performed after performing coherence filtering processing or Wiener filter processing; however, these processing sequences may be reversed.

In each of the exemplary embodiments above, where possible processing in which a frequency domain signal was processed may be configured as processing on a time domain signal, and conversely, where possible processing in which a time domain signal was processed, may be configured as processing on a frequency domain signal.

Although examples are given in each of the exemplary embodiments above of cases in which immediate processing is performed on a signal picked up by a pair of microphones, the audio signal that is the target of processing of the present invention is not limited thereto. For example, the present invention can also be applied in cases in which processing is performed on a pair of audio signals read from a recording medium, and the present invention can also be applied in cases in which processing is performed on a pair of audio signals transmitted from counterpart devices.

The entire contents of the disclosure of Japanese Patent Application No. 2012-221537 is incorporated by reference in the present specification.

All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. An audio signal processing device that suppresses noise components from input audio signals, the audio signal processing device comprising:

a first directionality forming section that by performing delay-subtraction processing on an input audio signal forms a first directional signal imparted with a directionality characteristic having a null in a first specific direction;

a second directionality forming section that by performing delay-subtraction processing on the input audio signal forms a second directional signal imparted with a directionality characteristic having a null in a second specific direction different from the first specific direction;

a coherence computation section that obtains a coherence using the first and second directional signals;

a target-sound segment detection section that by comparing the coherence with a first determination threshold value determines whether the input audio signal is a segment of a target-sound arriving from a target direction, or a non-target-sound segment other than the target-sound segment;

a target-sound segment determination threshold value controller that based on the coherence detects an interfering-sound segment from among non-target-sound segments including both the interfering-sound segment and a background noise segment, that obtains an interfering-sound average coherence value representing an average coherence value in the interfering-sound segment, and that controls the first determination threshold value based on the interfering-sound average coherence value;

a gain controller that sets a voice switch gain according to a determination result of the target-sound segment detection section; and a voice switch gain multiplication section that multiplies the input audio signal by the voice switch gain obtained by the gain controller.

2. The audio signal processing device of claim 1, wherein the target-sound segment determination threshold value controller comprises:

an interfering-sound coherence average acquisition section that detects a non-target-sound segment by comparing the coherence with a second determination threshold value having a fixed value, that after obtaining data representing a degree of long-term variation in the coherence of the non-target-sound segment, detects an interfering-sound segment by comparing instantaneous values of the coherence, and that updates the interfering-sound average coherence value when an update condition is satisfied including at least being an interfering-sound segment, and preserves the interfering-sound average coherence value when the update condition is not satisfied;

a correspondence relationship holding section that holds correspondence relationship data between the interfering-sound average coherence value and the first determination threshold value; and a target-sound segment determination threshold value acquisition section that obtains from the correspondence relationship holding section the first threshold value corresponding to the current interfering-sound average coherence value obtained by the interfering-sound average coherence computation section.

3. The audio signal processing device of claim 2, wherein, after computing a non-target-sound average coherence value representing the average value of coherence in a non-target-sound segment, the interfering-sound average coherence acquisition section detects the interfering-sound segment by comparing the absolute value of the difference between the instantaneous value of the coherence and the non-target-sound average coherence value, against a third determination threshold.

4. The audio signal processing device of claim 3, wherein the update condition of the interfering-sound average coherence acquisition section is a condition of being an interfering-sound segment and the instantaneous value of the coherence being greater than the non-target-sound average coherence value.

5. The audio signal processing device of claim 3, wherein the interfering-sound average coherence acquisition section comprises a holding section that holds a past detection result indicating whether or not an interfering-sound segment was detected, and when a change is made from a segment other than an interfering-sound segment to an interfering-sound segment, and that at a specific time period from the change, increases the instantaneous value of the coherence to a degree reflecting the interfering-sound average coherence value.

6. The audio signal processing device of claim 1, further comprising a spectral subtraction section that is disposed at an input side or output side of the voice switch gain multiplication section, and that performs noise suppression by subtracting non-target-sound signal components from an input signal to the spectral subtraction section.

7. The audio signal processing device of claim 1, further comprising a coherence filter computation section that is disposed at an input side or output side of the voice switch gain multiplication section, and that suppresses signal components that are offset from the arrival direction by multiplying each frequency of an input signal to the coherence filter computation section by a plurality of respective coefficients that are elements in deriving for each frequency the coherence using averaging processing of the plurality of coefficients.

8. The audio signal processing device of claim 1, further comprising a Weiner filter computation section that is disposed at an input side or output side of the voice switch gain multiplication section, and that eliminates noise by multiplying the input signal to the Weiner filter computation section by a coefficient obtained by estimating a noise characteristic for respective frequencies from a signal of a noise segment.

9. An audio signal processing method that suppresses noise components from input audio signals, the audio signal processing method comprising:

by a first directionality forming section, forming a first directional signal imparted with a directionality characteristic having a null in a first specific direction by performing delay-subtraction processing on an input audio signal;

by a second directionality forming section, forming a second directional signal imparted with a directionality characteristic having a null in a second specific direction different from the first specific direction by performing delay-subtraction processing on the input audio signal;

by a coherence computation section, calculating a coherence using the first and second directional signals;

by a target-sound segment detection section, comparing the coherence with a first determination threshold value, and determining whether the input audio signal is a segment of a target-sound arriving from a target direction, or a non-target-sound segment other than the target-sound segment;

by a target-sound segment determination threshold value controller, detecting based on the coherence an interfering-sound segment from among non-target-sound segments including both the interfering-sound segment and a background noise segment, obtaining an interfering-sound average coherence value representing an average coherence value in the interfering-sound segment, and controlling the first determination threshold value based on the interfering-sound average coherence value;

by a gain controller, setting a voice switch gain according to a determination result of the target-sound segment detection section; and by a voice switch gain multiplication section, multiplying the input audio signal by the voice switch gain obtained by the gain controller.

10. A non-transitory computer readable medium having computer program instructions for audio signal processing stored thereon, execution of the computer program instructions by a computer causing the computer to provide functions of:

a first directionality forming section that by performing delay-subtraction processing on an input audio signal forms a first directional signal imparted with a directionality characteristic having a null in a first specific direction;

a second directionality forming section that by performing delay-subtraction processing on the input audio signal forms a second directional signal imparted with a directionality characteristic having a null in a second specific direction different from the first specific direction;

a coherence computation section that obtains a coherence using the first and second directional signals;

a target-sound segment detection section that by comparing the coherence with a first determination threshold value determines whether the input audio signal is a segment of a target-sound arriving from a target direction, or a non-target-sound segment other than the target-sound segment;

a target-sound segment determination threshold value controller that based on the coherence detects an interfering-sound segment from among non-target-sound segments including both the interfering-sound segment and a background noise segment, that obtains an interfering-sound average coherence value representing an average coherence value in the interfering-sound segment, and that controls the first determination threshold value based on the interfering-sound average coherence value;

a gain controller that sets a voice switch gain according to a determination result of the target-sound segment detection section; and a voice switch gain multiplication section that multiplies the input audio signal by the voice switch gain obtained by the gain controller.

* * * * *